US008827658B2

(12) United States Patent
Yamamoto et al.

(10) Patent No.: US 8,827,658 B2
(45) Date of Patent: Sep. 9, 2014

(54) CEILING FAN

(75) Inventors: Kiminobu Yamamoto, Shiga (JP); Tetsuji Kawazu, Osaka (JP); Hiroshi Yoshikawa, Aichi (JP); Kiyohiko Iwamoto, Aichi (JP)

(73) Assignee: Panasonic Corporation, Osaka (JP)

( * ) Notice: Subject to any disclaimer, the term of this patent is extended or adjusted under 35 U.S.C. 154(b) by 642 days.

(21) Appl. No.: 12/920,474

(22) PCT Filed: Feb. 27, 2009

(86) PCT No.: PCT/JP2009/000875

§ 371 (c)(1),
(2), (4) Date: Sep. 1, 2010

(87) PCT Pub. No.: WO2009/110201

PCT Pub. Date: Sep. 11, 2009

(65) Prior Publication Data

US 2011/0002783 A1 Jan. 6, 2011

(30) Foreign Application Priority Data

Mar. 4, 2008 (JP) ..... 2008-053010
Nov. 28, 2008 (JP) ..... 2008-303980

(51) Int. Cl.
*F04D 25/08* (2006.01)
*F04D 29/60* (2006.01)

(52) U.S. Cl.
CPC ..... *F04D 25/088* (2013.01); *F04D 29/601* (2013.01)
USPC ..... 417/63; 417/423.15

(58) Field of Classification Search
CPC ..... F04D 25/088; F04D 29/601
USPC ..... 417/44.1, 63, 360, 423.1, 423.15, 417/424.1; 416/210 R; 415/13
See application file for complete search history.

(56) References Cited

U.S. PATENT DOCUMENTS 4,729,725 A * 3/1988 Markwardt ..... 417/423.15
8,241,017 B2 * 8/2012 Yamamoto et al. ..... 417/423.1
2006/0073732 A1 4/2006 Vilarchao et al.

FOREIGN PATENT DOCUMENTS

CN 2237173 Y 10/1996
CN 1758836 4/2006
CN 200958496 10/2007
JP 3-294696 12/1991
JP 4-347391 12/1992
JP 05-157092 * 6/1993 ..... F04D 25/08
JP 5-157092 6/1993

(Continued)

OTHER PUBLICATIONS

International Search Report of PCT Application No. PCT/JP2009/000875, dated May 19, 2009.

*Primary Examiner* — Bryan Lettman
(74) *Attorney, Agent, or Firm* — Panasonic Patent Center

(57) ABSTRACT

A ceiling fan includes a motor which rotates a plurality of blades, a shaft projecting from the motor, a pipe connected to an upper end of the shaft and which hangs from a ceiling surface, and a connecting rod for connecting the pipe and the shaft with each other via through holes formed in the pipe and the shaft, respectively. The ceiling fan also includes a displacement-correspondence tool which is displaced or which detects a displacement amount in correspondence with a relative positional displacement amount between the shaft and the pipe, and a power source control tool which controls energization to the motor in accordance with the displacement of the displacement-correspondence tool or the detected displacement amount.

11 Claims, 24 Drawing Sheets

(56) References Cited

FOREIGN PATENT DOCUMENTS

| | | | | |
|---|---|---|---|---|
| JP | 7-141034 | | 6/1995 | |
| JP | 9-9688 | | 1/1997 | |
| JP | 11-210680 | * | 8/1999 | ..... F04D 27/00 |
| JP | 3032325 B | | 2/2000 | |
| JP | 2006-62263 | | 3/2006 | |
| JP | 2006-97642 | | 4/2006 | |
| JP | 2006-097642 | | 4/2006 | |
| JP | 2006-329627 | | 12/2006 | |
| WO | WO2008059665 | * | 5/2008 | ..... F04B 35/04 |

* cited by examiner

CEILING FAN

CROSS-REFERENCE TO RELATED APPLICATIONS

This U.S. National stage application claims priority under 35 U.S.C. §119(a) to Japanese Patent Application No. 2008-053010, filed in Japan on Mar. 4, 2008 and 2008-303980, filed in Japan on Nov. 28, 2008, the entire contents of which are hereby incorporated herein by reference.

TECHNICAL FIELD

The present invention relates to a ceiling fan hanging from a ceiling.

BACKGROUND ART

Conventionally, as one example of the ceiling fan of this kind, a ceiling fan which informs that a mounting screw thereof is loose by means of an alarm device (see patent document 1, for example).

The conventional ceiling fan is described below with reference to FIG. 24 of a side view of an essential portion of the ceiling fan. Pipe 101 penetrating a center of ceiling fan 100 is suspended by mounting clamp 103 through hemispherical flange 102. Mounting clamp 103 is mounted, by coupling screw 106, on mounting plate 105 which is mounted on ceiling surface 110 through wood screw 104. Microswitch 107 is provided on mounting clamp 103 and actuator 108 of microswitch 107 abuts against a ceiling surface.

According to conventional ceiling fan 100, when wood screw 104 used to mount mounting plate 105 or coupling screw 106 which is used to mount mounting clamp 103 on mounting plate 105 is loosened, the alarm device or the like is operated through microswitch 107 to enhance a safety level. However, a structure of ceiling fan 100 has a problem that when a shaft (not shown) provided on a side of a motor and pipe 101 hanging from the ceiling are connected to each other, if the shaft and pipe 101 are not sufficiently fastened by a screw and not fixed to each other, a strength for holding ceiling fan 100 becomes insufficient by repetition of stop of operation of the motor and speed change of the motor, and the safety level of the hanging state is lowered.

A patent document 2 discloses another conventional ceiling fan. If this ceiling fan hangs from a ceiling and is operated, a large rocking motion is generated in a ceiling fan body depending upon an installing place.

That is, since a plurality of fan blades constituting the ceiling fan body are mounted at the installing place, unbalance is generated between the plurality of mounted fan blades in many cases. If the unbalance is generated between the mounted fan blades, a large rocking motion is generated in the ceiling fan body when the ceiling fan is operated, a connected portion of the ceiling fan body is abnormally worn by the rocking motion, and this may lead to a falling accident of the body.

To avoid this point, in some ceiling fans, a wire or the like for preventing the falling accident is fixed to the ceiling fan body, but there is caused a problem that if an excessive load is applied to the wire for a long term, the wire is cut and the ceiling fan body falls as a result.

[Patent Document 1] Japanese Patent No. 3,032,325

[Patent Document 2] Unexamined Japanese Patent Publication No. H03-294696

DISCLOSURE OF THE INVENTION

The present invention provides a ceiling fan comprising a motor which rotates a plurality of blades provided in a horizontal direction, a shaft projecting from an upper portion of the motor, a pipe which is connected to an upper end of the shaft and which hangs from a ceiling surface, a connecting rod for connecting the pipe and the shaft with each other via through holes formed in the pipe and the shaft, respectively, a female screw which is threadedly engaged with the connecting rod, a displacement-correspondence tool which is displaced or which detects a displacement amount in correspondence with a relative positional displacement amount between the shaft and the pipe, and a power source control tool which controls energization to the motor in accordance with the displacement of the displacement-correspondence tool or the detected displacement amount.

According to this ceiling fan, when the female screw is not strongly fixed to the connecting rod, an axial torque caused by a rotation force of the motor is applied to a connected portion between the shaft and the pipe by repetition of stop of operation of the motor and speed change of the motor, the connecting rod or the through hole is gradually worn, and a safety level is lowered. However, since energization to the motor is controlled by the displacement-correspondence tool which corresponds to the relative displacement amount between the shaft and the pipe, it is possible to prevent a worn state of the connected portion from developing. As a result, the strength for holding the ceiling fan and a hanging state having a high safety level can be maintained.

Further, the present invention provides a ceiling fan comprising connecting clamp fixed to a ceiling, and a ceiling fan body hanging from the connecting clamp through a hanging device, wherein the hanging device includes a first connecting portion which can be mounted on the connecting clamp, and a second connecting portion provided on a lower portion of the first connecting portion, the ceiling fan body includes a motor which rotates a plurality of fan blades provided in a horizontal direction, a shaft projecting from an upper portion of the motor, and a joint portion fixed to an upper portion of the shaft, the joint portion is movably mounted on the second connecting portion, and the ceiling fan further comprises an abnormal-rotation detector which detects rotation of the ceiling fan body and stops the motor when a body rotation-preventing device provided on the joint portion and one of the first connecting portion or the second connecting portion is released.

Since the ceiling fan includes the body rotation-preventing device and the abnormal-rotation detector, when a large rocking motion is generated in the ceiling fan body at the time of operation, the body rotation-preventing device is released, and the ceiling fan body starts rotating. Next, the abnormal-rotation detector detects the rotation of the ceiling fan body and the operation of the motor can be stopped. Therefore, even if the ceiling fan body is operated and a large rocking motion is generated in a state where the fan blades are abnormally mounted, the rocking motion is detected and the operation of the ceiling fan can be stopped. Accordingly, the large rocking motion is generated in the ceiling fan body at the time of operation, and this rocking motion can avoid a falling accident of the body which may be caused by abnormal wear of the connected portion of the ceiling fan body.

REFERENCE MARKS IN THE DRAWINGS

Figure 1:
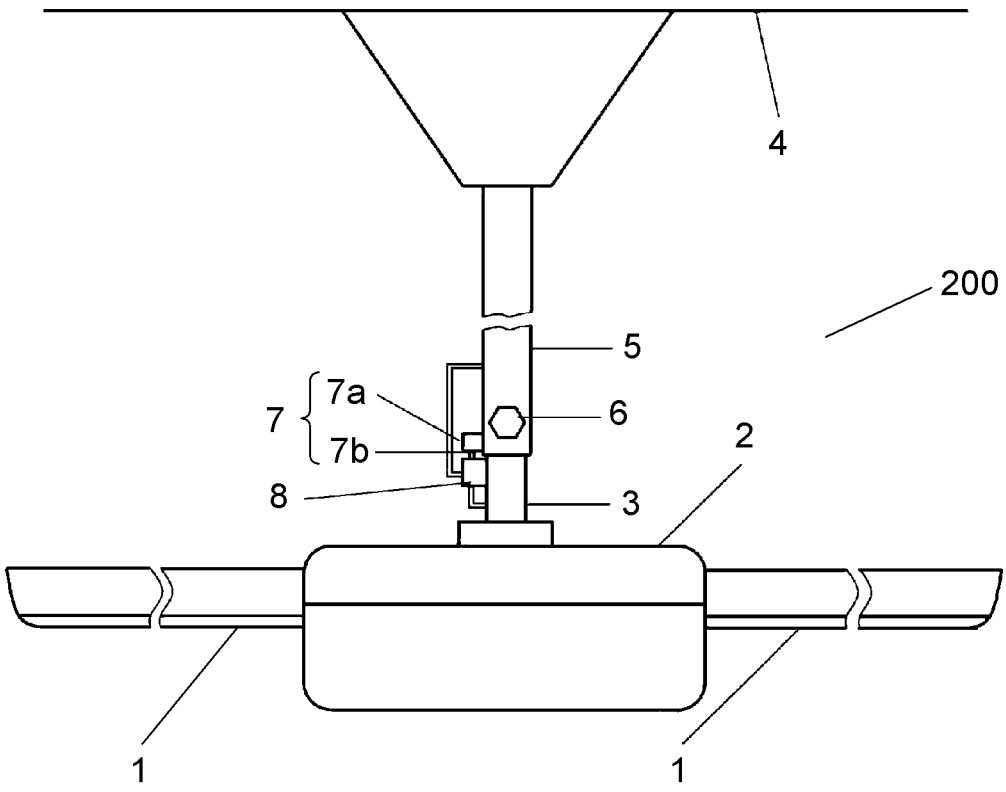
FIG. 1 is a side view of an entire ceiling fan according to a first embodiment of the present invention.

1 blade
2 motor
3, 51 shaft
4 ceiling surface
5 pipe
6 connecting rod
7 displacement-correspondence tool
7*a* pipe-side displacement-correspondence tool
7*b* shaft-side displacement-correspondence tool
8 power source control tool
8*a* power source supplying tool
8*b* power source receiving tool
9 end
10, 65 female connector
11, 66 male connector
12 through hole
13 female screw
14 flanged cap
15, 23, 70, 83 magnet
16, 72 metal plate
17 controller
18 threshold value adjustor
19 magnetic detector
20 reflector plate
21 infrared emitter
22 infrared receiver
24 infrared rays
25 tip end
26 flange
27 alarm
41 ceiling
42 connecting clamp
43 hanging device
44 ceiling fan body
45 first connecting portion
46 second connecting portion
47 hanging frame
48 pulley
49 shaft
50 spacer
52 notch
53 fan blade
54 joint portion
55 receiving portion
56 body rotation-preventing device
57, 57*a*, 57*b*, 57*c*, 57*d* abnormal-rotation detector
58 projection
59 groove
60 gap
61, 61*b*, 61*c*, 61*d* ball joint
62 angle portion
63, 63*a*, 63*b*, 63*c*, 63*d* first rotation detecting tool
64, 64*a*, 64*b*, 64*c*, 64*d* second rotation detecting tool
67 cord dip
68 cord
69 charging portion
71 first rotation detecting tool contact
73 second rotation detecting tool contact
80, 80*c*, 80*d* control device
81, 81*c*, 81*d* first detecting tool mounting portion
82, 82*c*, 82*d* first detecting tool detecting portion
84 magnetic detecting portion
85 threshold value adjustor
86 push-on switch
90 reflector plate
91 infrared emitter
92 infrared receiver

PREFERRED EMBODIMENTS FOR CARRYING OUT OF THE INVENTION

Embodiments of the present invention are described below with reference to the drawings.

First Embodiment

Figure 2:
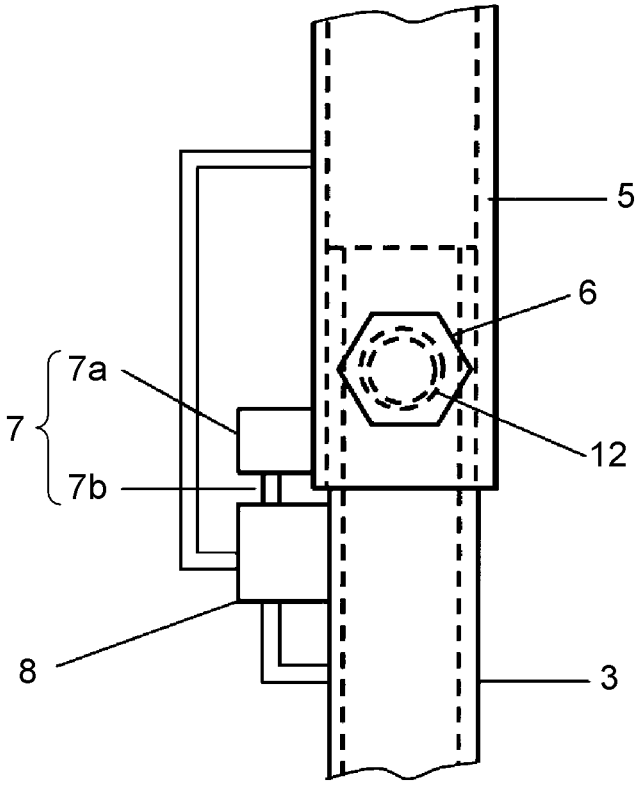
FIG. 2 is a side view of an essential portion of the ceiling fan.

FIG. 1 is a side view of an entire ceiling fan according to a first embodiment of the invention, and FIG. 2 is a side view of an essential portion of the ceiling fan. Motor 2 of ceiling fan 200 rotatably supports a plurality of blades 1 which are radially disposed in a horizontal direction and shaft 3 projects from an upper portion of motor 2. A lower end of pipe 5 having a large diameter is connected to an upper end of shaft 3 having a small diameter, and an upper end of pipe 5 is engaged with a fixing clamp (not shown) fixed to ceiling surface 4, thereby hanging ceiling fan 200 from ceiling surface 4.

Figure 3:
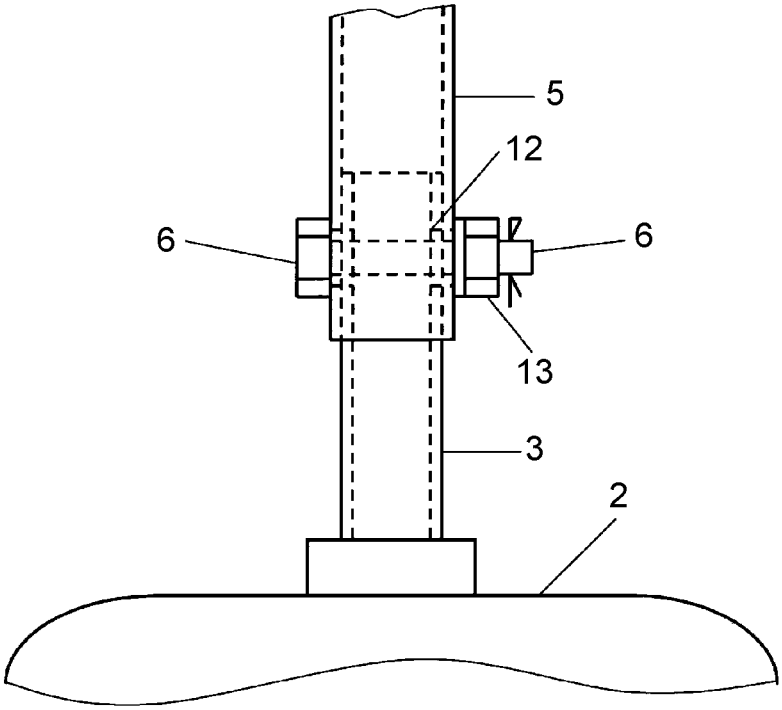
FIG. 3 is a side view of an essential portion of the ceiling fan shown in FIG. 2 as viewed from a different direction.

FIG. 3 is a side view of an essential portion of the ceiling fan shown in FIG. 2 as viewed from a different direction. Pipe 5 and shaft 3 are formed with through holes 12, respectively, and are connected to each other by bolt-like connecting rod 6 to penetrate through holes 12. Female screw 13 is threadedly engaged with connecting rod 6, and pipe 5 and shaft 3 are fixed to each other.

Figure 4:
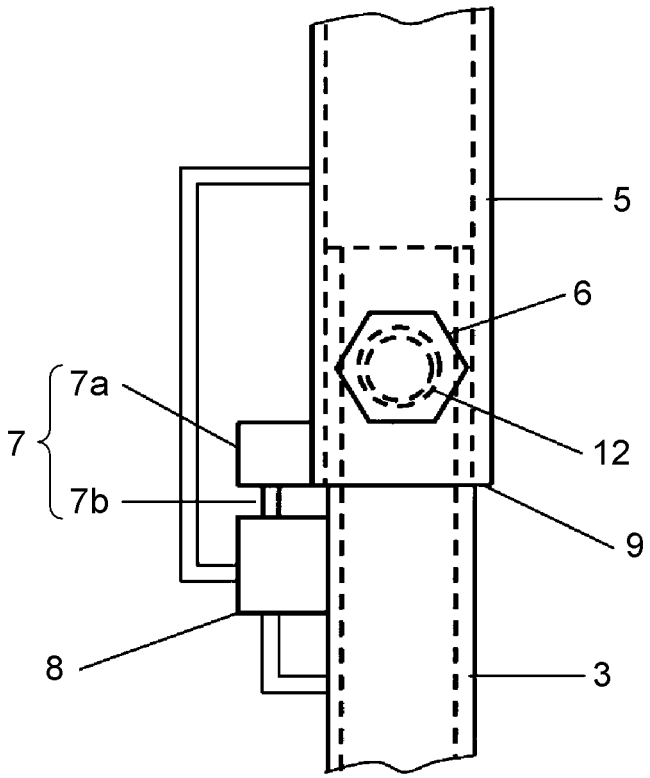
FIG. 4 is a side view of an essential portion showing a relation between a pipe and a displacement-correspondence tool of the ceiling fan according to the first embodiment of the invention.
Figure 5:
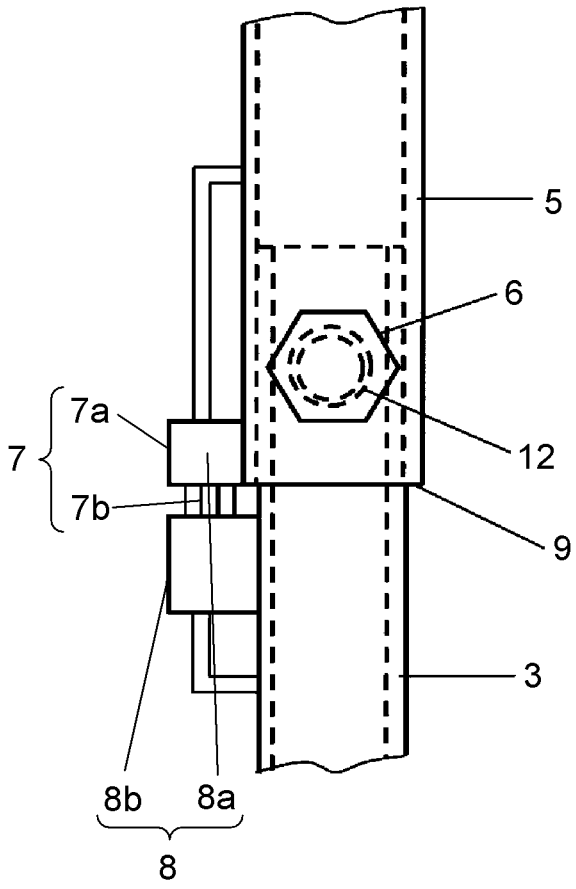
FIG. 5 is a side view of an essential portion showing a relation between the displacement-correspondence tool and a power source control tool of the ceiling fan.
Figure 6:
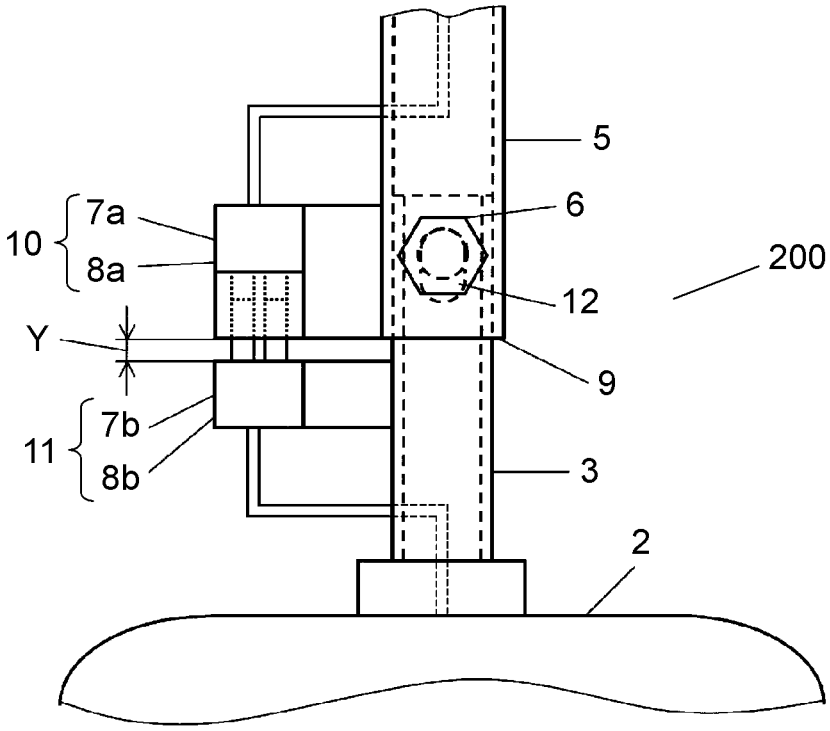
FIG. 6 is a side view of an essential portion showing a displacement state between the pipe and a shaft of the ceiling fan.

According to the first embodiment of the present invention, FIG. 4 is a side view of an essential portion showing a relation between a pipe and a displacement-correspondence tool of the ceiling fan, FIG. 5 is a side view of an essential portion showing a relation between the displacement-correspondence tool and a power source control tool of the ceiling fan, and FIG. 6 is a side view of an essential portion showing a displacement state between the pipe and a shaft of the ceiling fan.

Ceiling fan 200 includes displacement-correspondence tool 7 which is displaced in correspondence with a relative positional displacement amount between shaft 3 and pipe 5 or detects displacement amount Y, and power source control tool 8 which controls energization to motor 2 in accordance with the displacement of displacement-correspondence tool 7 or detected displacement amount Y.

Displacement-correspondence tool 7 is provided so as to be divided into shaft-side displacement-correspondence tool 7*b* provided on the side of shaft 3 and pipe-side displacement-correspondence tool 7*a* provided on the side of pipe 5.

Displacement-correspondence tool 7 is fixed with respect to end 9 of pipe 5. Power source control tool 8 can be divided into power source supplying tool 8*a* provided on pipe-side displacement-correspondence tool 7*a* and power source receiving tool 8*b* provided on shaft-side displacement-correspondence tool 7*b*.

Figure 7:
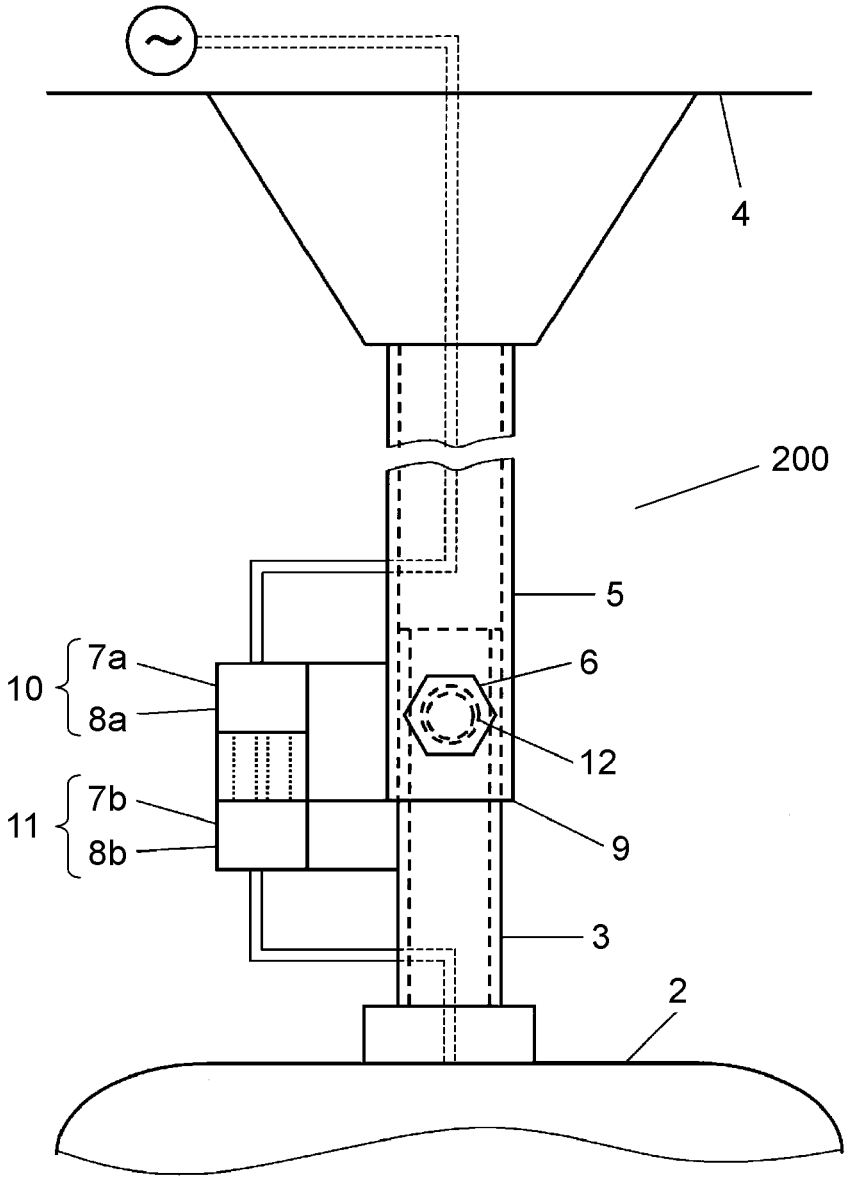
FIG. 7 is a side view of an essential portion showing a connected state between a female connector and a male connector of the ceiling fan.
Figure 8:
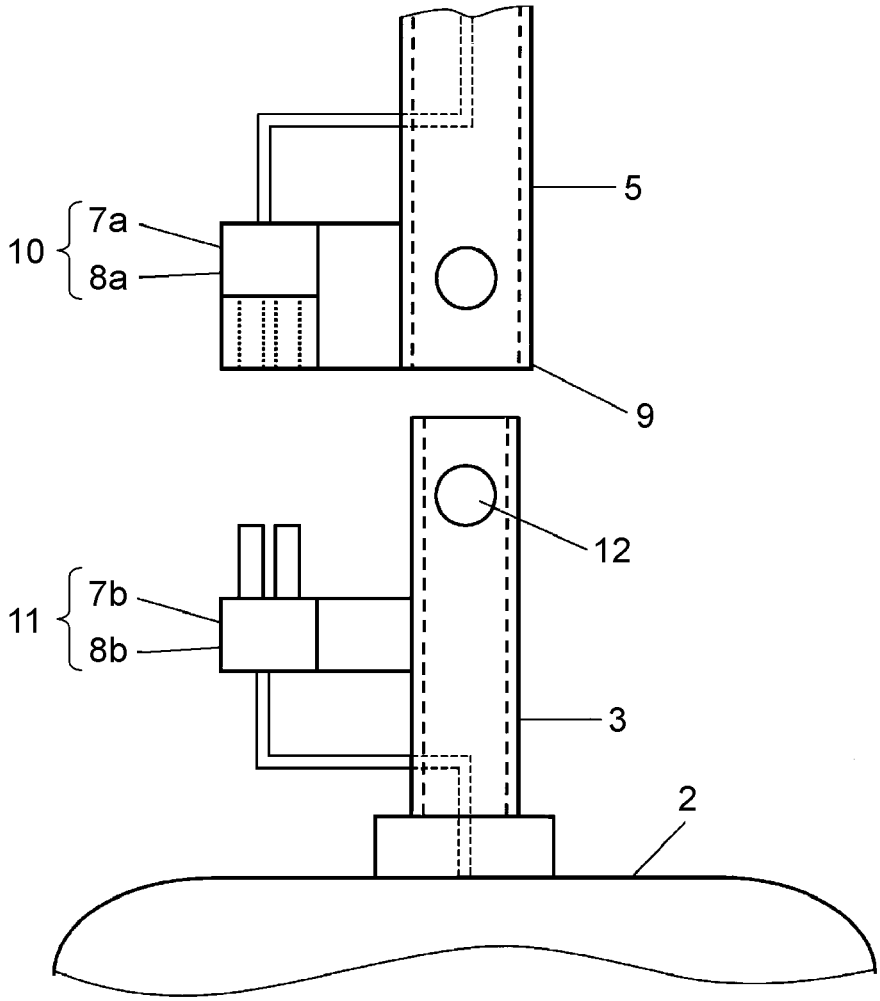
FIG. 8 is a side view of an essential portion showing a separated state between the female connector and the male connector of the ceiling fan.

According to the first embodiment of the present invention, FIG. 7 is a side view of an essential portion showing a connected state between a female connector and a male connector of the ceiling fan, and FIG. 8 is a side view of an essential portion showing a separated state between the female connector and the male connector of the ceiling fan.

Power source supplying tool 8*a* and pipe-side displacement-correspondence tool 7*a* provided on the side of pipe 5 are integrally formed together as female connector 10. Power source receiving tool 8*b* and shaft-side displacement-correspondence tool 7*b* provided on the side of shaft 3 are integrally formed together as male connector 11.

According to the above configuration, shaft 3 of motor 2 to rotate the blades 1 hangs from pipe 5 which hangs from ceiling 4. At that time, an upper portion of hollow shaft 3 having the small diameter is inserted into a lower portion of hollow pipe 5 having the large diameter. Bolt-like connecting rod 6 penetrates through holes 12 formed in shaft 3 and pipe 5, the other end of connecting rod 6 is threadedly engaged with and fixed by female screw 13, and shaft 3 is held. At that time, if female screw 13 is not strongly fixed to connecting rod 6, a gap is generated between shaft 3 and pipe 5.

That is, a bolt and the like is used as connecting rod 6 and a tip end of the penetrating bolt is strongly fastened into a nut, thereby eliminating the gap between shaft 3 and pipe 5. According to this configuration, even if an axial torque caused by a rotation force of motor 2 is applied to a connected portion between shaft 3 and pipe 5, shaft 3 is not rotated with respect to pipe 5, and connecting rod 6 or through hole 12 becomes less prone to be worn. However, when the ceiling fan is installed, it is not always true that the bolt is fastened strongly to such an extent that the gap between shaft 3 and pipe 5 is eliminated. When a gap is generated, the axial torque generated by the rotation force of motor 2 is applied to the connected portion between shaft 3 and pipe 5 by repetition of stop of operation of motor 2 and speed change of motor 2, connecting rod 6 or through hole 12 is gradually worn, and a position of shaft 3 is lowered with respect to pipe 5. At that time, power source control tool 8 controls energization to motor 2 in accordance with a displacement state or detected displacement amount Y by displacement-correspondence tool 7 which is displaced in correspondence with relative displacement amount Y between shaft 3 and pipe 5 or which detects detected displacement amount Y. This makes it possible to prevent a worn state of the connected portion from developing.

Displacement-correspondence tool 7 can be divided into shaft-side displacement-correspondence tool 7*b* and pipe-side displacement-correspondence tool 7*a*. According to this configuration, when pipe 5 and shaft 3 are connected to each other at the time of assembling operation of a product at an installing place, they can be connected to each other as the pair of the displacement-correspondence tools 7 at the same time. Therefore, it is possible to prevent an operator or a user from forgetting to mount displacement-correspondence tool 7. When pipe 5 and shaft 3 are not properly connected to each other, power source control tool 8 controls the energization to motor 2 in response to the relative positional displacement between shaft 3 and pipe 5 caused by wear of connecting rod 6 or through hole 12. As a result, it is possible to prevent ceiling fan 200 from being used in a state where a safety level against a falling accident thereof is low.

By fixing displacement-correspondence tool 7 with reference to end 9 of pipe 5, it is possible to easily position displacement-correspondence tool 7 when displacement-correspondence tool 7 is assembled, and to enhance the operability when the ceiling fan is installed or produced. Further, since it is possible to fix displacement-correspondence tool 7 by abutting displacement-correspondence tool 7 against end 9 of pipe 5, displacement-correspondence tool 7 can precisely be positioned, and detection precision of displacement or displacement amount Y which is to be detected can be enhanced.

Power source control tool 8 is provided so as to be divided into power source supplying tool 8*a* which is connected to a commercial power source and power source receiving tool 8*b* connected to motor 2. Since power source supplying tool 8*a* is mounted on pipe 5 and power source receiving tool 8*b* is mounted on shaft 3, when shaft 3 and pipe 5 are connected to each other, they function as a pair of displacement-correspondence tool 7 and power source control tool 8.

That is, when pipe 5 and shaft 3 are not properly connected to each other, if the position of shaft 3 is varied with respect to pipe 5 due to wear of connecting rod 6 or through hole 12, energization to motor 2 is stopped by power source control tool 8 which operates in association with displacement-correspondence tool 7. As a result, it is possible to stop the operation of ceiling fan 200 in a state where a safety level against a falling accident thereof is lowered.

Ceiling fan 200 includes female connector 10 in which pipe-side displacement-correspondence tool 7*a* and power source supplying tool 8*a* are integrally formed together, and male connector 11 in which shaft-side displacement-correspondence tool 7*b* and power source receiving tool 8*b* are integrally formed together. According to this configuration, when a dangerous state where shaft 3 is displaced downward relative to pipe 5 is created, a strong downward force exceeding a permissible range is applied to male connector 11 and female connector 10. Since male connector 11 and female connector 10 are separated away from each other, conduction to motor 2 is cut off, and the operation of ceiling fan 200 can be stopped.

Second Embodiment

Figure 9:
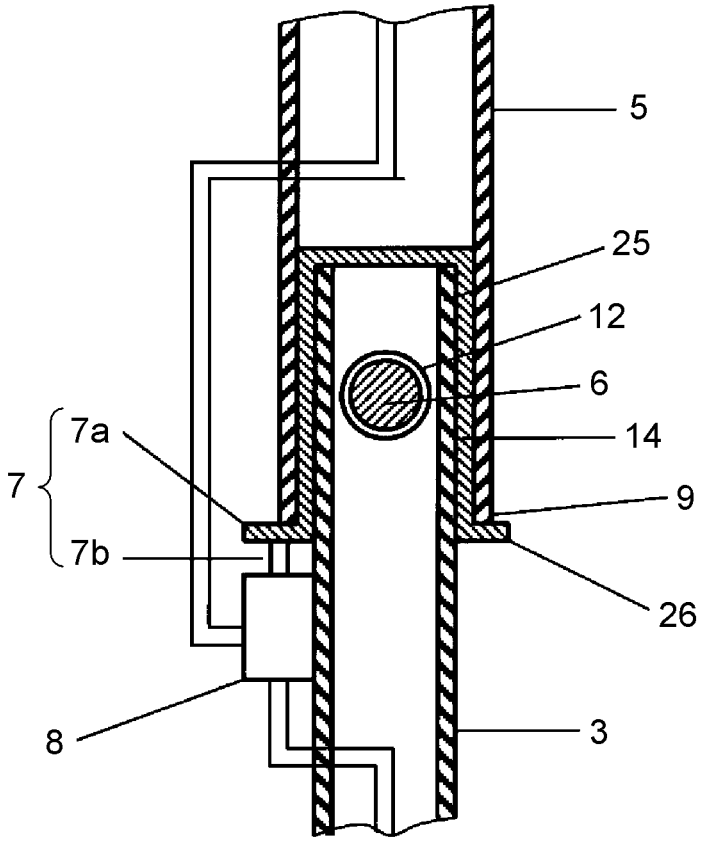
FIG. 9 is a side view of an essential portion showing a mounted state of a flanged cap of a ceiling fan according to a second embodiment of the invention.
Figure 10:
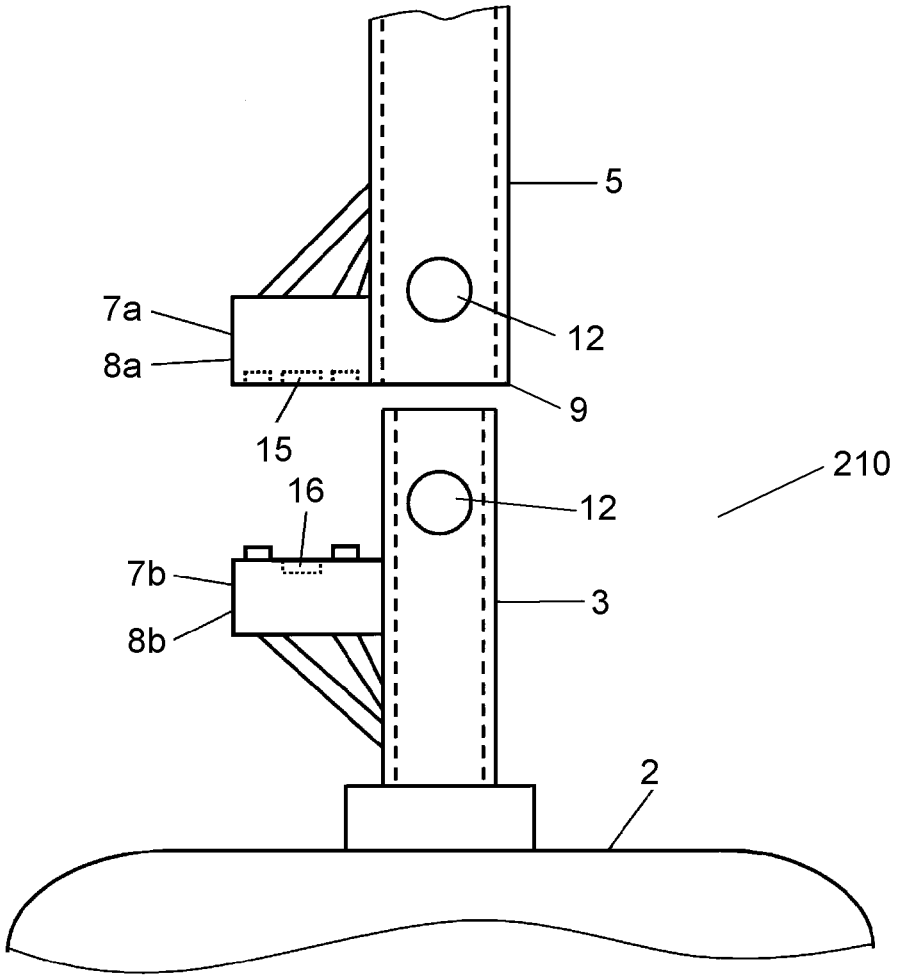
FIG. 10 is a side view of an essential portion showing a relation between a magnet and a metal plate of the ceiling fan.

FIG. 9 is a side view of an essential portion showing a mounted state of a flanged cap of a ceiling fan according to a second embodiment of the invention. FIG. 10 is a side view of an essential portion showing a relation between a magnet and a metal plate of the ceiling fan. In the second embodiment of the invention, only points which are different from the first embodiment are described.

Flanged cap 14 which covers tip end 25 of shaft 3 is fitted between shaft 3 and pipe 5, and material of flanged cap 14 is synthetic resin.

Furthermore, flanged cap 14 is substantially integrally fixed to pipe 5, and they become pipe-side displacement-correspondence tool 7*a*.

Further, magnet 15 is provided on one of shaft-side displacement-correspondence tool 7*b* and pipe-side displacement-correspondence tool 7*a*, and metal plate 16 is provided on the other tool.

According to this configuration, tip end 25 of shaft 3 is covered and flanged cap 14 fitted between shaft 3 and pipe 5 is provided, thereby protecting tip end 25 of shaft 3 and preventing tip end 25 from being deformed. Flanged cap 14 has such a guiding function that when tip end 25 of shaft 3 is inserted into pipe 5, flanged cap 14 slides and positions of holes are aligned with each other at a position where end 9 of pipe 5 abuts against flange 26 of flanged cap 14. Therefore, the mounting operability of shaft 3 and pipe 5 can be enhanced.

According to ceiling fan 210, a length of pipe 5 may be changed depending upon a height of a ceiling in some cases. If flanged cap 14 suitable for an inside dimension of pipe 5 is provided on shaft 3 of motor 2, one of pipes 5 which has a length corresponding to an installation place can freely be selected.

Furthermore, material of flanged cap 14 is synthetic resin. Even if inner diameter size precision of metal pipe 5 and outer diameter size precision of shaft 3 are low, a size and surface roughness can be absorbed by synthetic resin flanged cap 14. By increasing a degree of intimate contact between pipe 5 and shaft 3, connecting rod 6 or through hole 12 becomes less prone to be worn.

When an axial torque caused by a rotation force of motor 2 is applied to the connected portion between shaft 3 and pipe 5 by repetition of ON or OFF of motor 2, a contact sound or a scratchy sound may be generated from a gap or a backlash of the connected portion in some cases. However, since the flanged cap 14 is made of synthetic resin, it functions as a cushioning, and it is possible to prevent vibration from being transmitted, and to prevent an unusual sound from being generated.

Flanged cap 14 is substantially integrally fixed to pipe 5 and they are formed as pipe-side displacement-correspondence tool 7*a*. According to this configuration, when connecting rod 6 or through hole 12 is worn and a dangerous situation where pipe 5 and shaft 3 are displaced is generated, flanged cap 14 is reliably displaced together with pipe 5. Therefore, it is possible to precisely detect displacement amount Y between pipe 5 and shaft 3.

Shaft-side displacement-correspondence tool 7*b* and pipe-side displacement-correspondence tool 7*a* are formed as a combination of magnet 15 and metal plate 16. Power source receiving tool 8*b* is provided directly on or in the vicinity of shaft-side displacement-correspondence tool 7*b*, power source supplying tool 8*a* is provided directly on or in the vicinity of pipe-side displacement-correspondence tool 7*a*. According to this configuration, when the ceiling fan is used as usual, magnet 15 clings to metal plate 16, and power source supplying tool 8*a* and power source receiving tool 8*b* are connected to each other. However, if connecting rod 6 or through hole 12 is worn and displacement amount Y is increased, magnet 15 and metal plate 16 are separated from each other when downward gravity greater than the magnetic force applied to magnet 15 and metal plate 16 is applied thereto, and power source supplying tool 8*a* and power source receiving tool 8*b* are separated from each other. Therefore, energization to motor 2 is cut off, and ceiling fan 210 is safely stopped.

Third Embodiment

Figure 11:
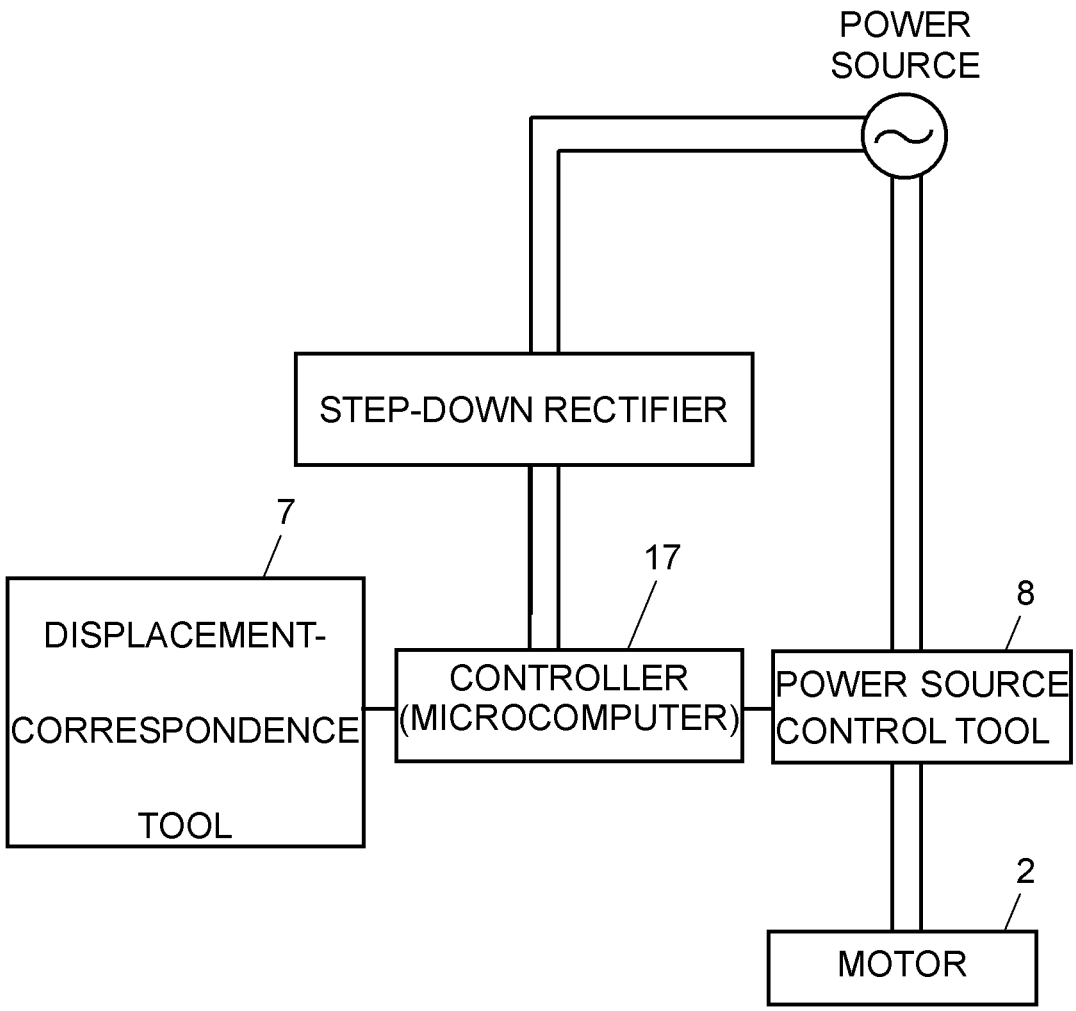
FIG. 11 is a block circuit diagram of a ceiling fan according to a third embodiment of the invention.
Figure 12:
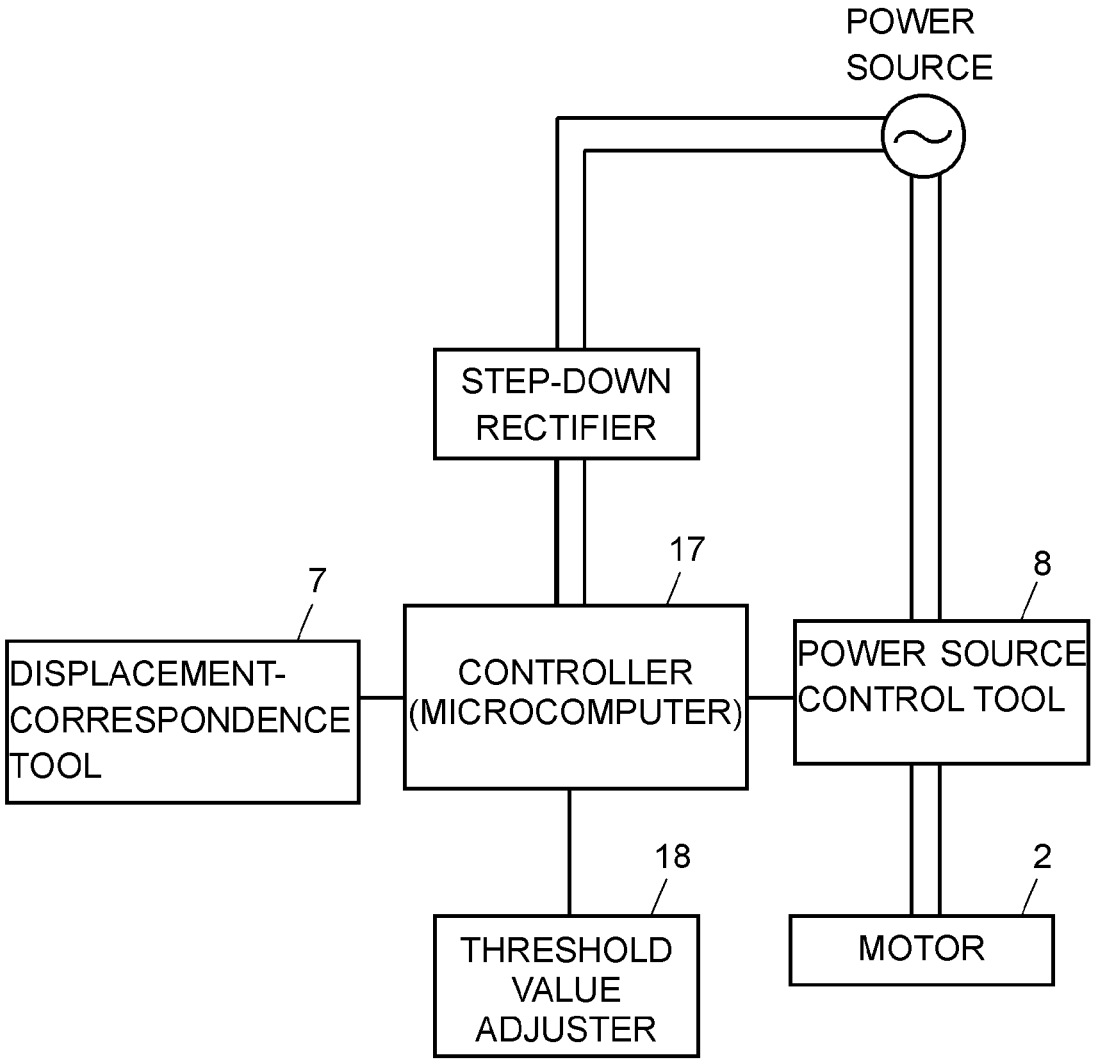
FIG. 12 is a block circuit diagram showing a relation between a controller and a threshold value adjustor of the ceiling fan.

FIG. 11 is a block circuit diagram of a ceiling fan according to a third embodiment of the invention. FIG. 12 is a block circuit diagram showing a relation between a controller and a threshold value adjustor of the ceiling fan. In the third embodiment of the invention, only points which are different from the first embodiment are described.

The ceiling fan includes displacement-correspondence tool 7 which detects displacement amount Y in correspondence with the relative positional displacement amount between shaft 3 and pipe 5, and controller 17 which receives a detection value from displacement-correspondence tool 7 as an electric signal. When the detection value exceeds a threshold value, controller 17 controls or stops energization to motor 2 through power source control tool 8.

Threshold value adjustor 18 is provided on the input side of controller 17 so that a threshold value can be adjusted.

Figure 13:
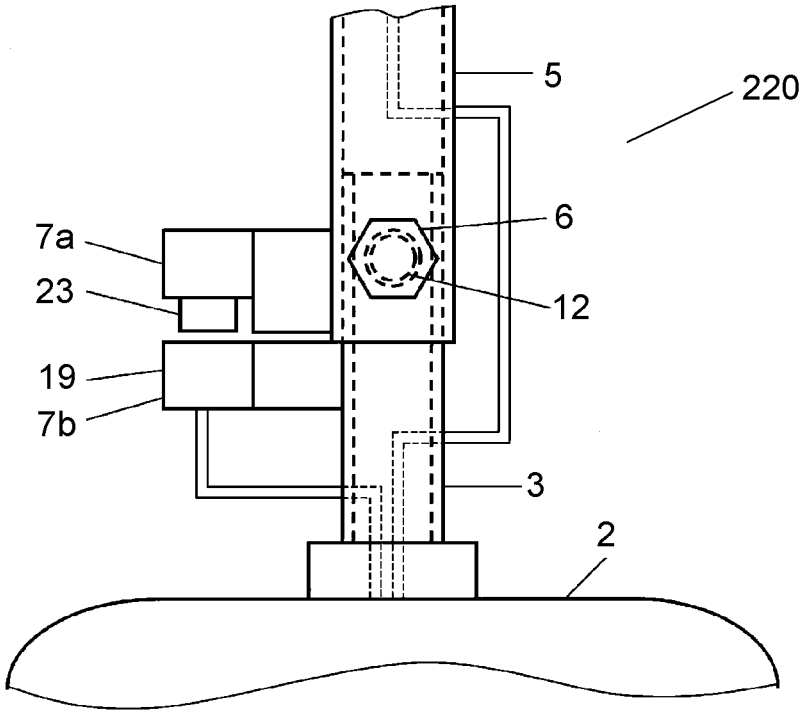
FIG. 13 is a side view of an essential portion showing rotation between a magnet and a magnetic detector of the ceiling fan.

FIG. 13 is a side view of an essential portion showing a relation between a magnet and a magnetic detector of the ceiling fan of the third embodiment of the invention. Ceiling fan 220 includes magnet 23 as pipe-side displacement-correspondence tool 7*a*, and magnetic detector 19 as shaft-side displacement-correspondence tool 7*b*. When a detection value of magnetic detector 19 becomes equal to or lower than a threshold value, controller 17 stops motor 2 or reduces the number of revolutions of motor 2.

Figure 14:
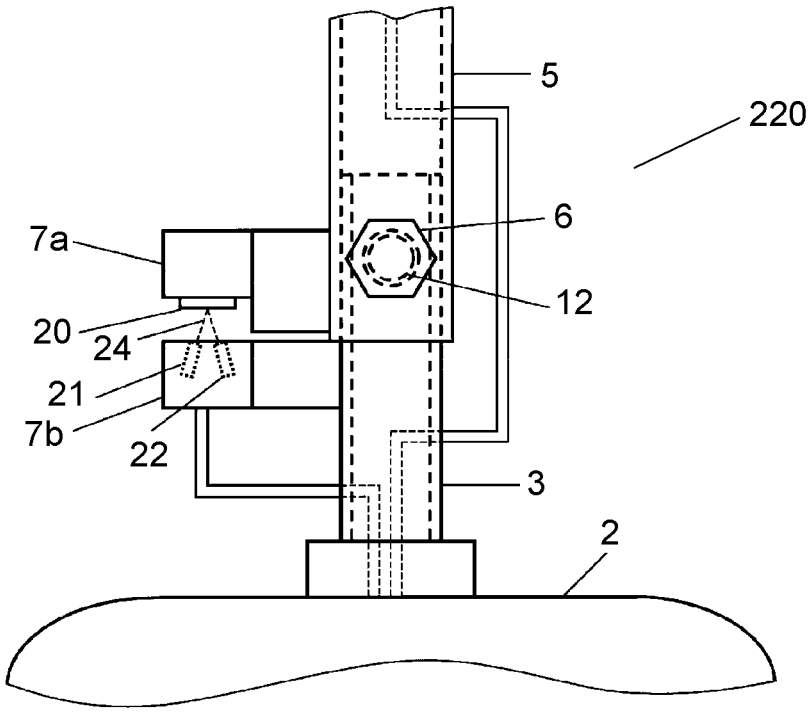
FIG. 14 is a side view of an essential portion showing a relation between an infrared receiver, an infrared emitter and a reflector plate of the ceiling fan.

FIG. 14 is a side view of an essential portion showing a relation between infrared receiver and emitter, and a reflector plate of the ceiling fan of the third embodiment of the invention. Ceiling fan 220 includes reflector plate 20 as pipe-side displacement-correspondence tool 7*a*, and infrared emitter 21 and infrared receiver 22 connected to controller 17 as shaft-side displacement-correspondence tool 7*b*. When a detection value of infrared receiver 22 is equal to or lower than a threshold value, controller 17 stops motor 2 or reduces the number of revolutions of motor 2.

Figure 15:
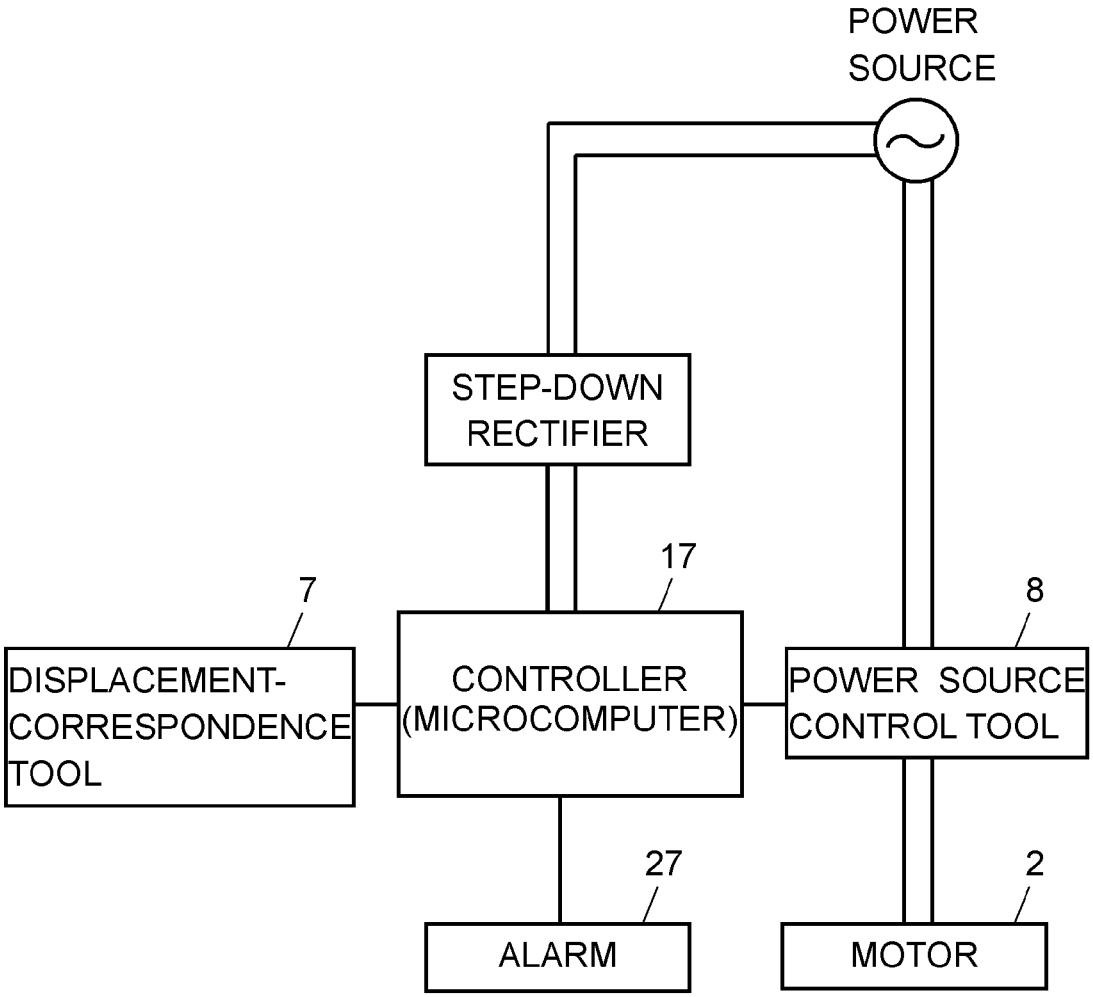
FIG. 15 is a block circuit diagram showing a relation between a controller and an alarm of the ceiling fan.

FIG. 15 is a block circuit diagram showing a relation between a controller and an alarm of the ceiling fan of the third embodiment of the invention. Ceiling fan 220 includes alarm 27 which informs a user of an abnormal condition when ceiling fan 220 stops motor 2 or reduces the number of revolutions of motor 2, and alarm 27 is provided in the vicinity of displacement-correspondence tool 7.

According to the above-described configuration, ceiling fan 220 includes displacement-correspondence tool 7 which is displaced in correspondence with a relative positional displacement amount between shaft 3 and pipe 5, and controller 17 which receives a detection value from displacement-correspondence tool 7 as an electric signal. Therefore, operation of ceiling fan 220 can be controlled by controller 17, and settings of the threshold value can also be changed in accordance with the positional displacement amount. When shaft 3 and pipe 5 are displaced and the detection value exceeds a set threshold value, controller 17 stops or controls energization to motor 2 through power source control tool 8, and it is possible to prevent a worn state of the connected portion from developing.

A threshold value which is to be compared with a displacement value detected by displacement-correspondence tool 7 is preset in controller 17. An adjustor is provided in an operating unit on the input side of controller 17 so that the set value of the threshold value can be adjusted. With this configuration, when the installing operation during which pipe 5 and shaft 3 are connected to each other is completed at the installing place, it is possible to set the threshold value corresponding to the detection value of displacement-correspondence tool 7 using the adjustor of the operating unit without making fine adjustments of displacement-correspondence tool 7. Therefore, a complicated adjusting operation for making fine adjustments of the connected portion after the installing operation becomes unnecessary, and it is possible to easily carry out the installing operation for securing safety.

Magnet 23 is provided as pipe-side displacement-correspondence tool 7*a*, and magnetic detector 19 connected to the input side of controller 17 is provided as shaft-side displacement-correspondence tool 7*b*. When the ceiling fan is used as usual, since magnet 23 is close to magnetic detector 19, a detection value of magnetic detector 19 is high, and ceiling fan 220 is operated normally. Even when connecting rod 6 or through hole 12 is worn and the detection value of magnetic detector 19 becomes equal to or lower than the threshold value, controller 17 stops energization to motor 2 or reduces the number of revolutions of motor 2, thereby preventing a worn state of the connected portion from developing and securing safety.

Reflector plate 20 is provided as pipe-side displacement-correspondence tool 7*a*, and a pair of infrared emitter 21 and infrared receiver 22 is provided on reflector plate 20 as shaft-side displacement-correspondence tool 7*b* such that infrared emitter 21 and infrared receiver 22 are opposed to each other at a shallow angle. Therefore, when the ceiling fan is operated as usual, infrared rays 24 from infrared emitter 21 are reflected on reflector plate 20, infrared rays 24 enter infrared receiver 22 and therefore, the detection value of infrared receiver 22 is high and the ceiling fan is operated normally.

When shaft 3 is displaced downward relative to pipe 5, however, since a distance between infrared emitter 21 and reflector plate 20 is increased, infrared rays 24 reflected on reflector plate 20 enter infrared receiver 22 at a location separated away from a center of infrared receiver 22. As a result, the detection value of infrared receiver 22 is largely reduced and becomes equal to or lower than the threshold value, and controller 17 stops energization to motor 2 or reduces the number of revolutions of motor 2, thereby preventing a worn state of the connected portion from developing and securing safety.

Alarm 27 for informing a user of an abnormal condition is provided in the vicinity of displacement-correspondence tool 7. Therefore, when a dangerous situation where shaft 3 is displaced downward relative to pipe 5 is generated, alarm 27 is actuated when controller 17 stops energization to motor 2 or reduces the number of revolutions of motor 2, and alarm 27 informs a user that the ceiling fan is abnormally stopped or is operating in a situation corresponding to the abnormal condition. Since alarm 27 is provided in the vicinity of displacement-correspondence tool 7, it is possible to easily determine a location which should be checked, and to swiftly prepare for an exchanging operation of a part or the like.

If an audio device using beeps or sound, or a visual display device using LED blinking or character representation is used as alarm 27, it is possible to inform a user of an abnormal condition.

Fourth Embodiment

Figure 16:
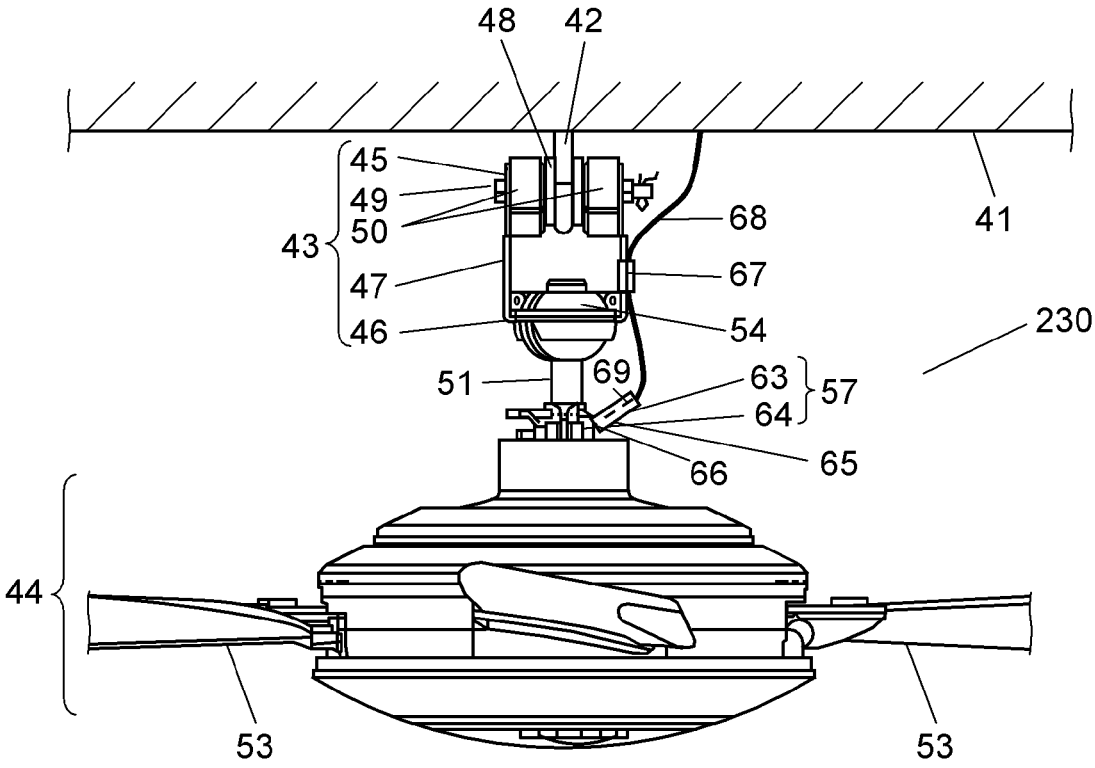
FIG. 16 is an appearance diagram showing a ceiling fan according to a fourth embodiment of the invention.
Figure 17:
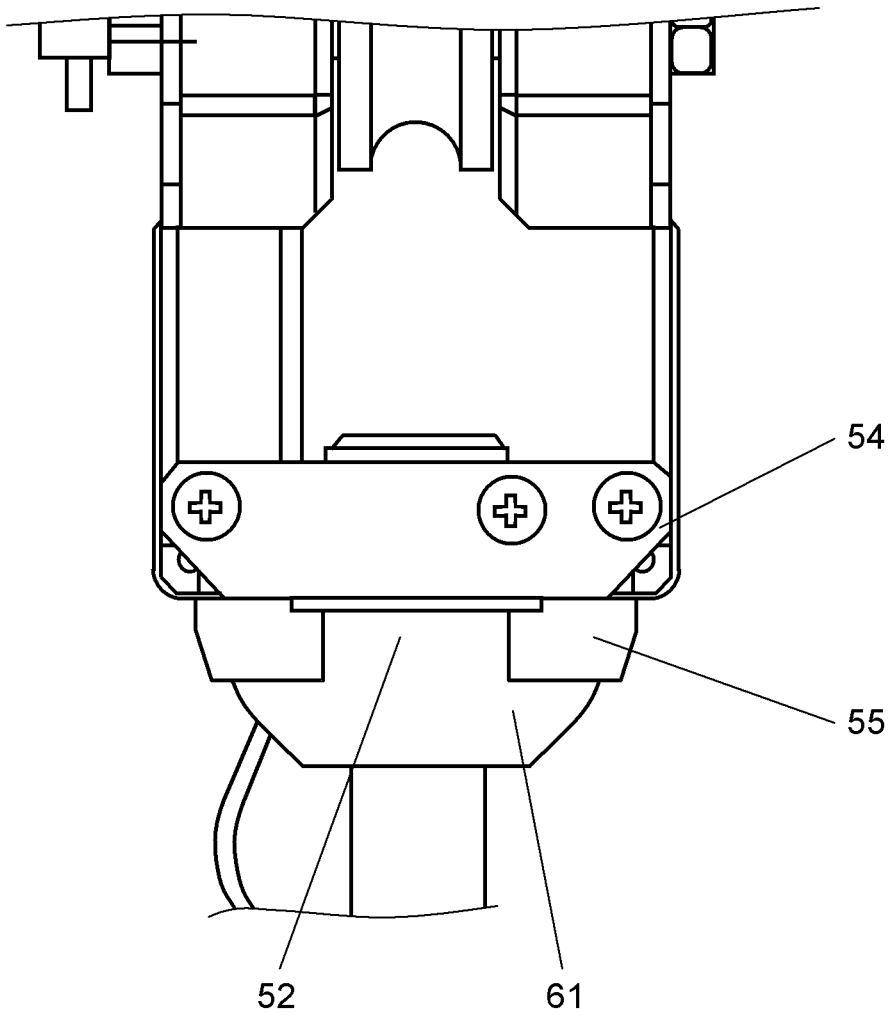
FIG. 17 is a side view of an essential portion showing the ceiling fan.
Figure 18:
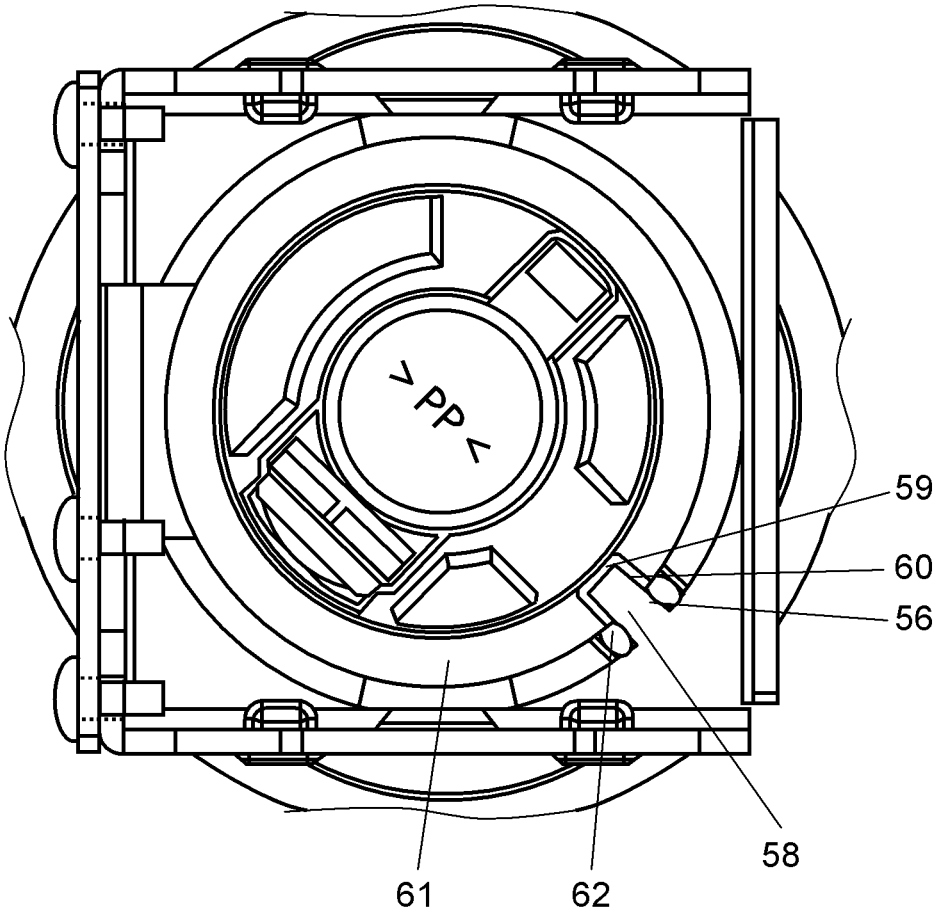
FIG. 18 is a diagram of the ceiling fan as viewed from below.

FIG. 16 is an appearance diagram showing a ceiling fan according to a fourth embodiment of the invention. FIG. 17 is a side view of an essential portion showing the ceiling fan. FIG. 18 is a diagram of the ceiling fan as viewed from below. According to ceiling fan 230, ceiling fan body 44 hangs from connecting clamp 42 fixed to ceiling 41 through hanging device 43.

Connecting clamp 42 is a columnar wire material, an upper end thereof is fixed to ceiling 41, and a lower end thereof is formed into a J-shape using the wire material so that hanging device 43 can be hooked on the lower end of the connecting clamp 42. Hanging device 43 includes first connecting portion 45 in which connecting clamp 42 is hooked on an upper portion of U-shaped hanging frame 47, and second connecting portion 46 in which joint portion 54 is movably fitted to a lower portion of first connecting portion 45.

First connecting portion 45 includes columnar shaft 49 horizontally fixed to hanging frame 47, disk-like pulley 48 which is rotatably inserted into shaft 49 and which is provided at its central portion of its outer periphery with a recessed groove, and two hollow columnar spacers 50 provided on both ends of pulley 48. Shaft 49 is used for fixing pulley 48 in the vicinity of a center of shaft 49, and is inserted into spacers 50.

Second connecting portion 46 is formed into a bowl-like shape for movably holding a spherical surface. Receiving portion 55 having notch 52 is integrally formed on hanging frame 47, and shaft 51 can pass through notch 52.

Ceiling fan body 44 includes a motor (not shown) which rotates a plurality of fan blades 53 provided in the horizontal direction, columnar shaft 51 projecting from an upper portion of the motor, and joint portion 54 including substantially hemispherical ball joint 61 fixed to an upper portion of shaft 51. Joint portion 54 can movably be mounted on second connecting portion 46.

That is, a spherical portion of ball joint 61 is movably fitted into receiving portion 55.

The ceiling fan of the fourth embodiment of the invention is characterized in that the ceiling fan includes abnormal-rotation detector 57 which detects a rotation of ceiling fan body 44 and stops the operation of the motor when body rotation-preventing device 56 provided on joint portion 54 and on one of first connecting portion 45 and second connecting portion 46 is released.

Body rotation-preventing device 56 is formed into a bowl-like shape for movably holding a spherical surface of second connecting portion 46. Body rotation-preventing device 56 includes rectangular plate-like metal projection 58, and groove 59 having substantially a rectangular cross section. Projection 58 is integrally formed on receiving portion 55 having notch 52, and shaft 51 can pass through notch 52.

Groove 59 is formed in a vertical direction to a substantially hemispherical surface of ball joint 61 which is joint portion 54.

In a state where the spherical portion of ball joint 61 is movably fitted into receiving portion 55 and in this fitting state, projection 58 is fitted into groove 59 of ball joint 61, and gap 60 is provided between groove 59 and projection 58.

Since gap 60 is provided between groove 59 and projection 58, projection 58 can easily be fitted into groove 59 of ball joint 61 when the spherical portion of substantially hemispherical ball joint 61 which is joint portion 54 is movably fitted thereto.

When ceiling fan body 44 is operated, ball joint 61 is rotated by a rotation force of the motor in a direction opposite to a rotation direction of the motor of the horizontal direction. That is, when ball joint 61 is rotated in a horizontal direction, an inner surface of groove 59 of ball joint 61 and an angle portion 62 which intersects with an outer peripheral surface of ball joint 61 come into contact with an end surface of projection 58.

That is, when ceiling fan body 44 rocks, the inner surface of groove 59 of ball joint 61 and angle portion 62 which intersects with the outer peripheral surface of ball joint 61 come into contact with the end surface of projection 58.

Since the contacting surfaces are the angle portion 62 of ball joint 61 and the end surface of projection 58, the contact area is small. Therefore, a friction force is also small, and when ceiling fan body 44 is operated and rocking motion is generated, ball joint 61 can more smoothly move on receiving portion 55.

If ceiling fan body 44 is kept operating in a state where fan blades 53 are abnormally mounted, and when large rocking motion of ceiling fan body 44 is generated at the time of operation, angle portion 62 of ball joint 61 is largely moved vertically by the rocking motion, and angle portion 62 and one point of the end surface of projection 58 rub against each other. That is, the one point of the end surface of projection 58 having a small area is worn while angle portion 62 of ball joint 61 itself of an amount corresponding to the vertical moving distance is also worn.

An example of material of ball joint 61 is nylon 66 in which glass fiber is mixed. With this glass fiber, moving performance of ball joint 61 with respect to receiving portion 55 is enhanced, and it is also possible to cut down metal.

According to this configuration, projection 58 which is body rotation-preventing device 56 is cut down or broken off and as a result, body rotation-preventing device 56 is released.

When angle portion 62 of ball joint 61 is brought into contact with the end surface of projection 58 in this manner, projection 58 is cut down or broken off. Thus, it is possible to sense a large rocking motion caused by such a case that ceiling fan body 44 is kept operating in a state where fan blades 53 are abnormally mounted.

When projection 58 is cut down or broken off and ceiling fan body 44 is rotated, abnormal-rotation detector 57 stops the operation of the motor.

Abnormal-rotation detector 57 includes first rotation detecting tool 63 and second rotation detecting tool 64. First rotation detecting tool 63 is fixed to second connecting portion 46 and second rotation detecting tool 64 is fixed to ceiling fan body 44.

First rotation detecting tool 63 and second rotation detecting tool 64 are connected to each other such that they can be separated from each other, and they are also connecting portion of power source supply to the motor.

When ceiling fan body 44 rotates, first rotation detecting tool 63 and second rotation detecting tool 64 are separated from each other by a predetermined distance, thereby cutting off supply of power source to the motor, and the operation of ceiling fan body 44 can be stopped.

First rotation detecting tool 63 is in conduction with the power source and second rotation detecting tool 64 is in conduction with the motor.

Since first rotation detecting tool 63 located at an upper portion is in conduction with the power source which is supplied from the ceiling, second rotation detecting tool 64 located at a lower portion is in conduction with the motor, and it is possible to easily wire.

First rotation detecting tool 63 and second rotation detecting tool 64 are connected to each other by a fitting force and they are in conduction with each other. This fitting force is smaller than the rotation force of ceiling fan body 44 when it rotates.

First rotation detecting tool 63 and second rotation detecting tool 64 are connected to each other and brought into conduction with each other by the fitting force which is smaller than the rotation force of ceiling fan body 44 when it rotates. Therefore, when ceiling fan body 44 rotates, the connection between first rotation detecting tool 63 and second rotation detecting tool 64 is released, the supply of power source to the motor is cut off, and the operation of ceiling fan body 44 can be stopped.

More specifically, according to first rotation detecting tool 63, cord 68 connected to the power source is fixed to a side surface of hanging frame 47 by means of cord clip 67, female connector 65 is provided on a tip end of cord 68. According to second rotation detecting tool 64, male connector 66 is fixed to a top surface of ceiling fan body 44, and male connector 66 is in conduction with the motor.

First rotation detecting tool 63 which is in conduction with the power source supplied from the ceiling is female connector 65. Therefore, when ceiling fan body 44 rotates and connection between first rotation detecting tool 63 and second rotation detecting tool 64 is released, since female connector 65 is provided on the tip end of cord 68, female connector 65 can move, and a charging portion is surrounded by female connector 65 and is not exposed. As a result, charging portions do not come into contact with each other, the supply of a power source to the motor can be cut off safely, and the operation of ceiling fan body 44 can be stopped.

Male connector 66 which is second rotation detecting tool 64 is fixed to the top surface of ceiling fan body 44 such that charging portion 69 on the tip end of male connector 66 is inclined about 45° upward. Female connector 65 which is first rotation detecting tool 63 is fixed to a tip end of cord 68. Cord 68 is fixed to a side surface of hanging frame 47 at a position above a position where male connector 66 is fixed and at a position rotated 90° on a horizontal plane into a rotating direction of fan blades 53.

According to this configuration, an angle of cord 68 fixed by cord clip 67 from female connector 65 which is fitted to male connector 66 and an angle of charging portion 69 of male connector 66 are substantially the same. Therefore, a rotation force when ceiling fan body 44 rotates is applied in substantially the same direction as a direction in which fitted portions between male connector 66 and female connector 65 are separated from each other. Therefore, an unreasonable force is not applied to male connector 66, and male connector 66 and female connector 65 can be disengaged from each other.

Fifth Embodiment

Figure 19:
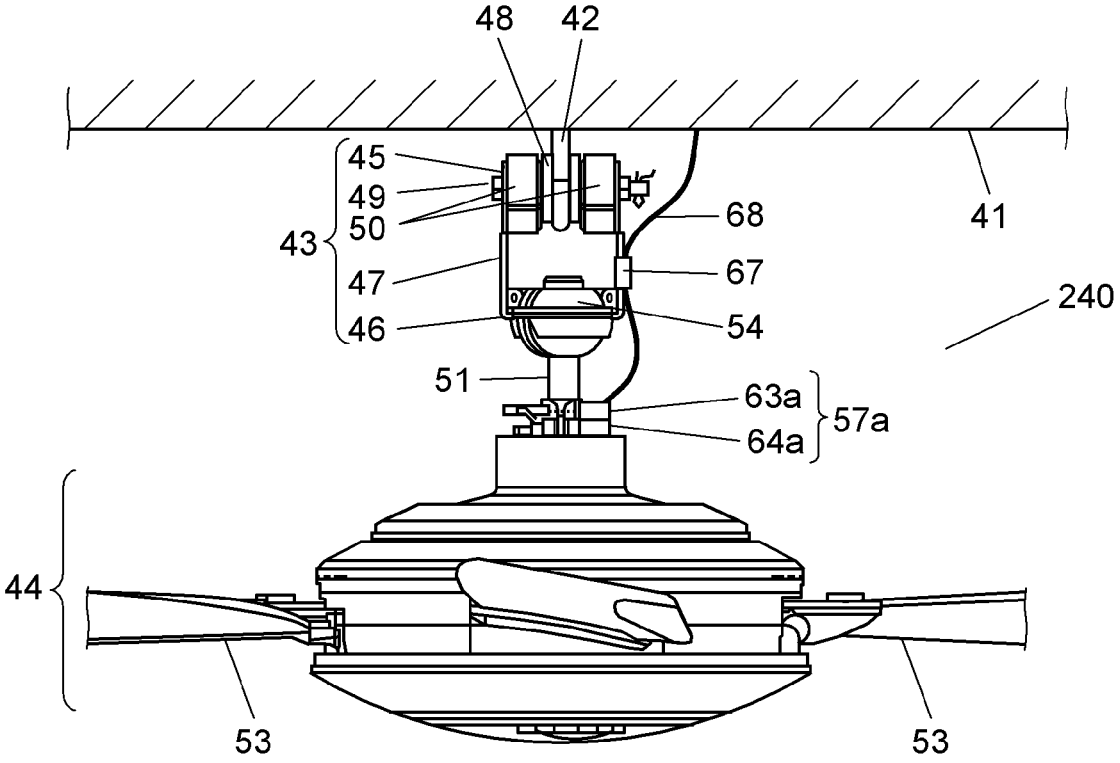
FIG. 19 is an appearance diagram showing a ceiling fan according to a fifth embodiment of the invention.
Figure 20:
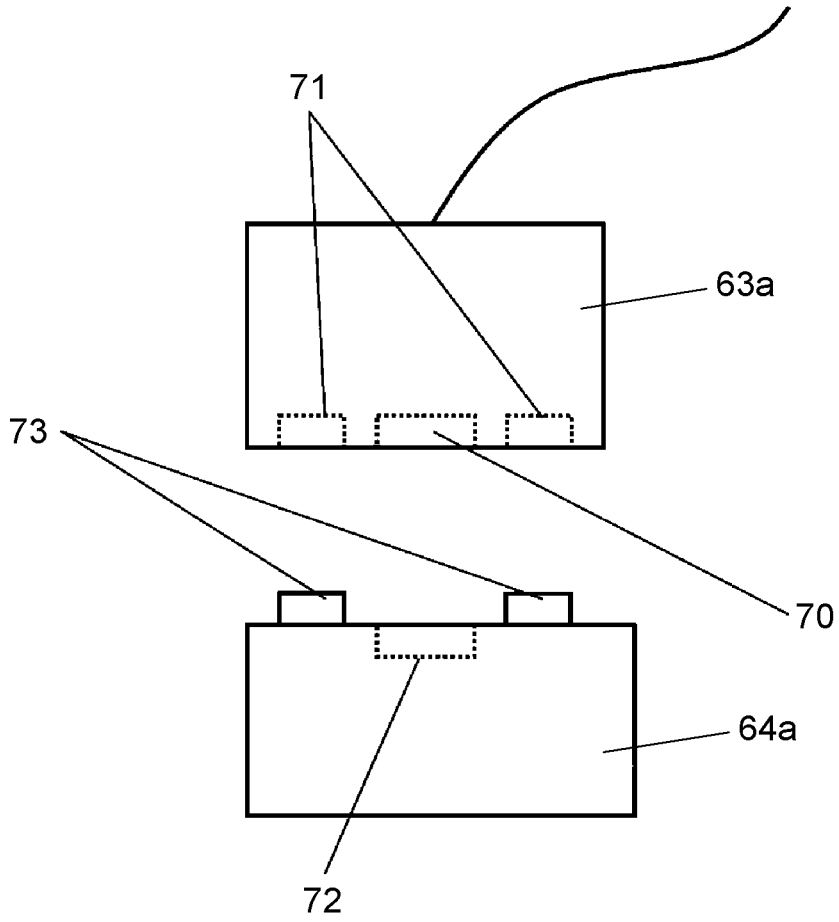
FIG. 20 is an appearance diagram showing an abnormal-rotation detector of the ceiling fan.

FIG. 19 is an appearance diagram showing a ceiling fan according to a fifth embodiment of the invention. FIG. 20 is an appearance diagram showing an abnormal-rotation detector of the ceiling fan. In the fifth embodiment of the invention, only points which are different from the fourth embodiment are described. Ceiling fan 240 of the fifth embodiment of the invention is different from ceiling fan 230 of the fourth embodiment of the invention in that abnormal-rotation detector 57*a* connects first rotation detecting tool 63*a* to second rotation detecting tool 64*a* each other through a magnetic force.

That is, first rotation detecting tool 63*a* and second rotation detecting tool 64*a* are connected to each other through the magnetic force and they are in conduction with each other. More specifically, flat plate-like magnet 70 is provided on a lower surface of first rotation detecting tool 63*a*, and first rotation detecting tool contact 71 is provided in the vicinity of magnet 70. Cord 68 is provided on an upper surface of first rotation detecting tool 63*a*, and first rotation detecting tool contact 71 is connected to a power source. Cord 68 is fixed to a side surface of hanging frame 47 through cord clip 67.

Flat plate-like metal plate 72 is provided on an upper surface of second rotation detecting tool 64*a*, and second rotation detecting tool contact 73 is provided in the vicinity of metal plate 72. A lower surface of second rotation detecting tool 64*a* is fixed to a top surface of ceiling fan body 44, and second rotation detecting tool contact 73 is in conduction with a motor.

If flat plate-like magnet 70 on a lower surface of first rotation detecting tool 63*a* and flat plate-like metal plate 72 on an upper surface of second rotation detecting tool 64*a* are clung to each other through a magnetic force, first rotation detecting tool contact 71 and second rotation detecting tool contact 73 are connected to each other, and the motor is brought into conduction with a power source.

A clinging force between magnet 70 and metal plate 72 through the magnetic force is smaller than a rotation force of ceiling fan body 44 when it rotates.

That is, in a state where fan blades 53 are abnormally mounted, ceiling fan body 44 is operated, a large rocking motion of ceiling fan body 44 is generated, projection 58 is cut down or broken off, and ceiling fan body 44 rotates in some cases. In such a case, connection of abnormal-rotation detector 57*a* is released by the magnetic force between magnet 70 and metal plate 72 by the rotation force of ceiling fan body 44. Connection between first rotation detecting tool contact 71 and second rotation detecting tool contact 73 is also released, supply of power source to the motor is cut off, and the operation of the motor can be stopped.

When the connection generated by the magnetic force is released by the rotation force of the ceiling fan body 44 by connecting them using the magnetic force, since the connecting force is only the magnetic force, the connection force is stabilized and as a result, detection of rotation of ceiling fan body 44 can be stabilized.

Sixth Embodiment

Figure 21:
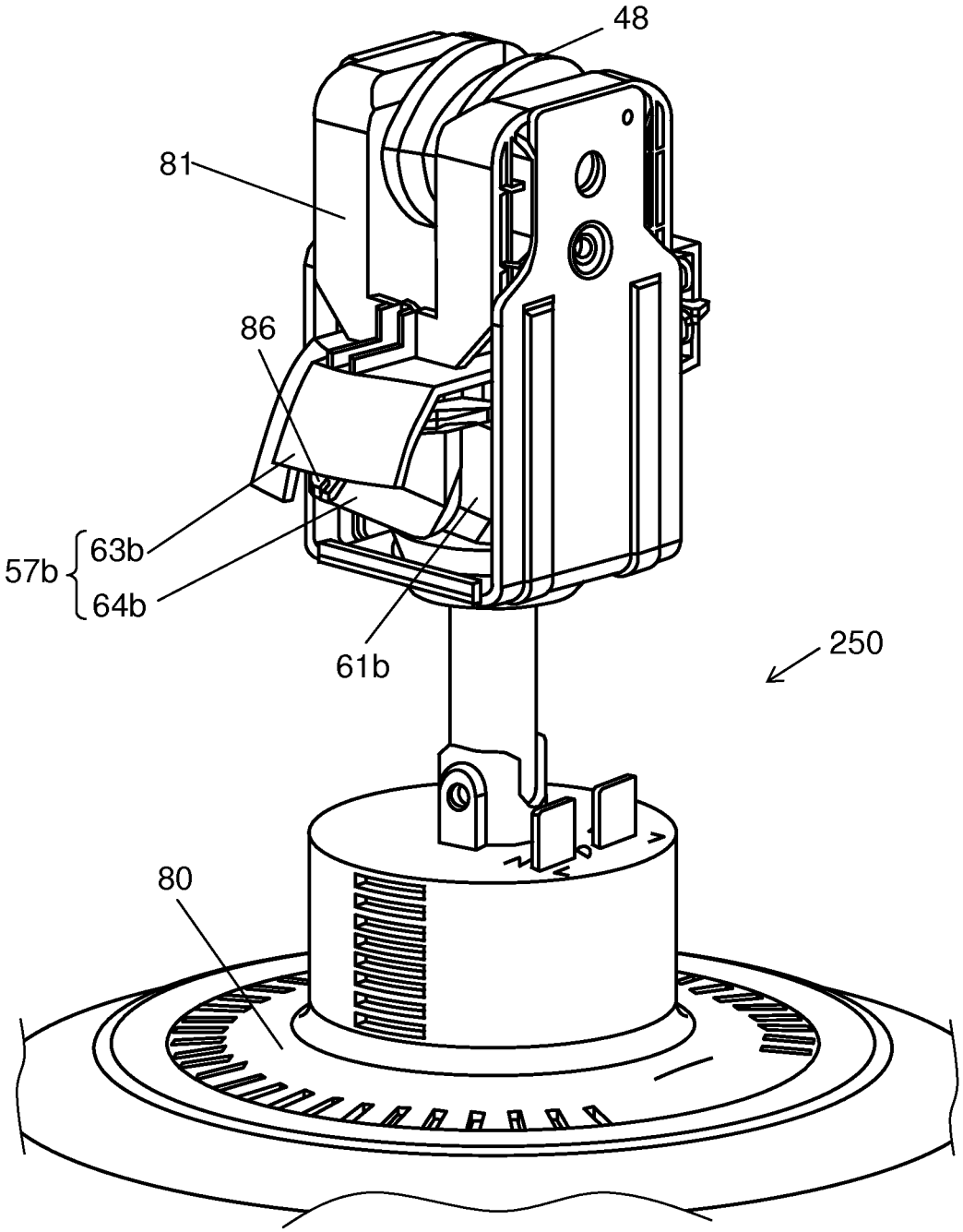
FIG. 21 is an appearance diagram showing a ceiling fan according to a sixth embodiment of the invention.

FIG. 21 is an appearance diagram showing a ceiling fan according to a sixth embodiment of the invention. In the sixth embodiment of the invention, only points which are different from the fourth embodiment are described. Ceiling fan 250 of the sixth embodiment of the invention is different from ceiling fan 230 of the fourth embodiment of the invention in an abnormal-rotation detector. As shown in FIG. 21, abnormal-rotation detector 57*b* includes first rotation detecting tool 63*b* and second rotation detecting tool 64*b*.

That is, abnormal-rotation detector 57*b* stops energization to a motor by displacement of a distance between first rotation detecting tool 63*b* and second rotation detecting tool 64*b*. More specifically, first rotation detecting tool 63*b* includes first detecting tool detecting portion 81, and shaft 49 is inserted into an upper portion of first detecting tool detecting portion 81. First detecting tool detecting portion 81 has a U-shaped cross section and sandwiches a disk-like pulley 48. Curved plate-like first detecting tool detecting portion is provided on a lower portion of first rotation detecting tool 63*b* so as to cover second rotation detecting tool 64*b*.

According to second rotation detecting tool 64*b*, push-on switch 86 is fixed to a side surface of ball joint 61*b* at a position opposed to first detecting tool detecting portion. Push-on switch 86 is energized in a contact state between push-on switch 86 and first rotation detecting tool 63*b*, and push-on switch 86 is not energized when push-on switch 86 is not in contact with first rotation detecting tool 63*b*.

An example of second rotation detecting tool 64*b* is a limit switch.

Specifically, in a state where fan blades are abnormally mounted, ceiling fan body 44 is operated, a large rocking motion is generated, projection 58 is cut down or broken off, and ceiling fan body 44 rotates in some cases. In such a case, push-on switch 86 of second rotation detecting tool 64*b* is not in contact with first rotation detecting tool 63*b*, and energization to the motor can be stopped.

Since the rotation of ceiling fan body 44 is recognized based on contact or non-contact of push-on switch 86 in this manner, even if ceiling fan body 44 rotates and push-on switch 86 is brought into non-contact state to first rotation detecting tool 63*b*, charging portion is not exposed.

Seventh Embodiment

Figure 22:
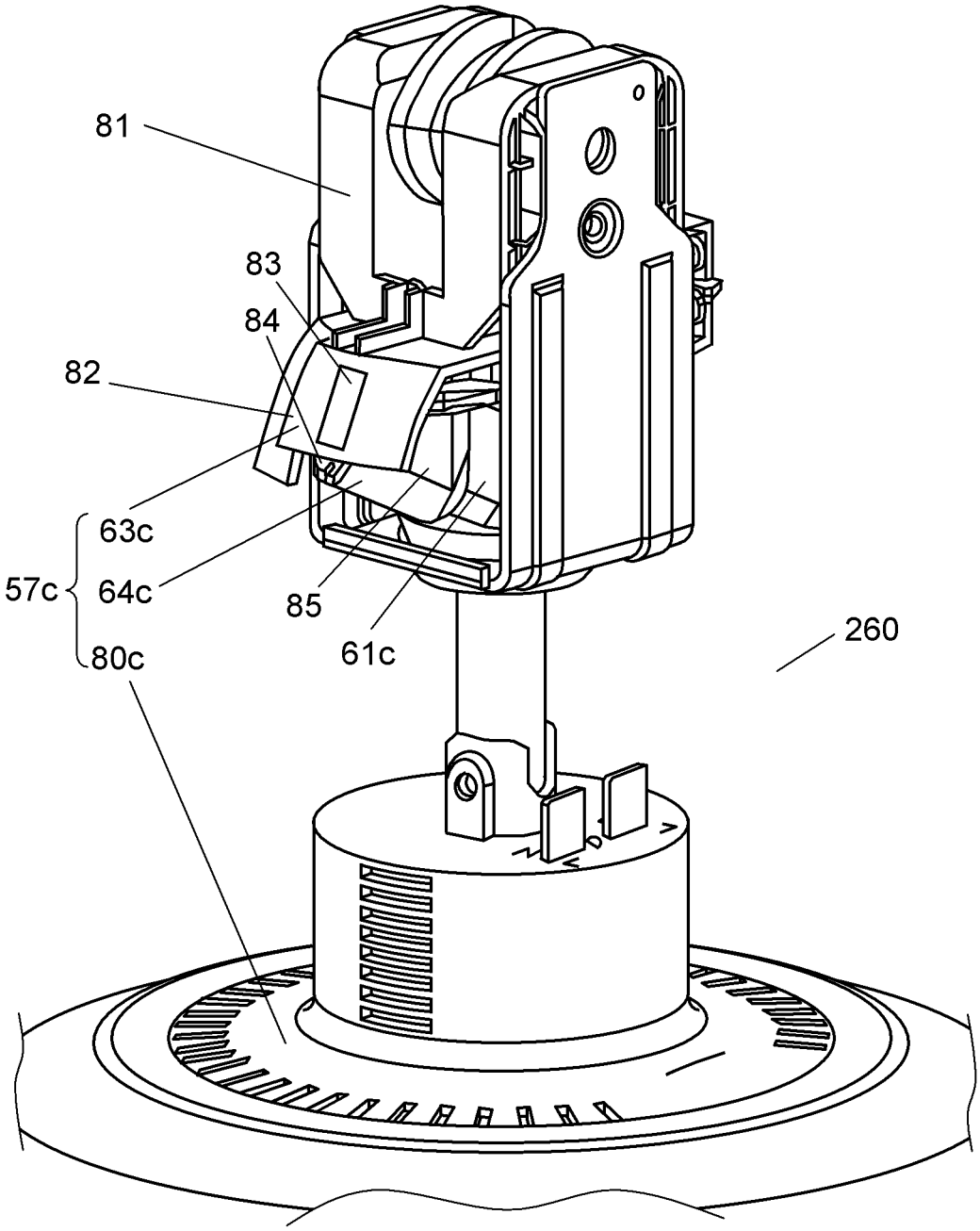
FIG. 22 is an appearance diagram showing a ceiling fan according to a seventh embodiment of the invention.

In a seventh embodiment of the invention, only points which are different from the fourth embodiment are described. FIG. 22 is an appearance diagram showing a ceiling fan according to a seventh embodiment of the invention. Ceiling fan 260 of the seventh embodiment of the invention is different from the ceiling fan 230 of the fourth embodiment of the invention in an abnormal-rotation detector.

Abnormal-rotation detector 57*c* includes first rotation detecting tool 63*c*, second rotation detecting tool 64*c* and control device 80*c*. That is, abnormal-rotation detector 57*c* sends a displacement of a distance between first rotation detecting tool 63*c* and second rotation detecting tool 64*c* as an electric signal by second rotation detecting tool 64*c*, and when the electric signal exceeds a predetermined threshold value, control device 80*c* stops energization to the motor.

Specifically, first rotation detecting tool 63*c* includes first detecting tool detecting portion 81, and shaft 49 is inserted into an upper portion of first detecting tool mounting portion 81. First detecting tool mounting portion 81 has a U-shaped cross section and sandwiches a disk-like pulley 48. Curved first detecting tool detecting portion 82 is provided on a lower portion of first rotation detecting tool 63*c* so as to cover second rotation detecting tool 64*c*. Flat magnet 83 is fixed to an inner surface of first detecting tool detecting portion 82. According to second rotation detecting tool 64*c*, magnetic detecting portion 84 is fixed to a side surface of ball joint 61 at a position opposed to flat magnet 83 of first detecting tool detecting portion 82. Magnetic detecting portion 84 detects a magnetic force of magnet 83, and sends a detection value to control device 80*c* as an electric signal.

Control device 80*c* is provided in ceiling fan body 44, receives the detection value from magnetic detecting portion 84 as an electric signal. When the detection value is equal to or lower than a predetermined threshold value, control device 80*c* stops energization to the motor.

Specifically, in a state where the fan blades are abnormally mounted, ceiling fan body 44 is operated, a large rocking motion is generated, projection 58 is cut down or broken off, and ceiling fan body 44 rotates in some cases. In such a case, magnetic detecting portion 84 of second rotation detecting tool 64*c* detects a magnetic force of magnet 83 of first rotation detecting tool 63*c*, and sends a detection value to control device 80*c* as an electric signal. When the detection value is equal to or lower than the predetermined threshold value, control device 80*c* can stop energization to the motor.

Magnet 83 of first rotation detecting tool 63*c* and magnetic detecting portion 84 of second rotation detecting tool 64*c* detect a magnetic force in a non-contact state, and recognize that ceiling fan body 44 rotates by variation in the magnetic force. Therefore, when ceiling fan body 44 rocks, it is possible to prevent wear of magnet 83 which is abnormal-rotation detector 57*c* and magnetic detecting portion 84.

Control device 80*c* includes threshold value adjustor 85 which can adjust the threshold value.

Since control device 80*c* includes threshold value adjustor 85, it is possible to adjust the threshold value at an installing place.

Eighth Embodiment

Figure 23:
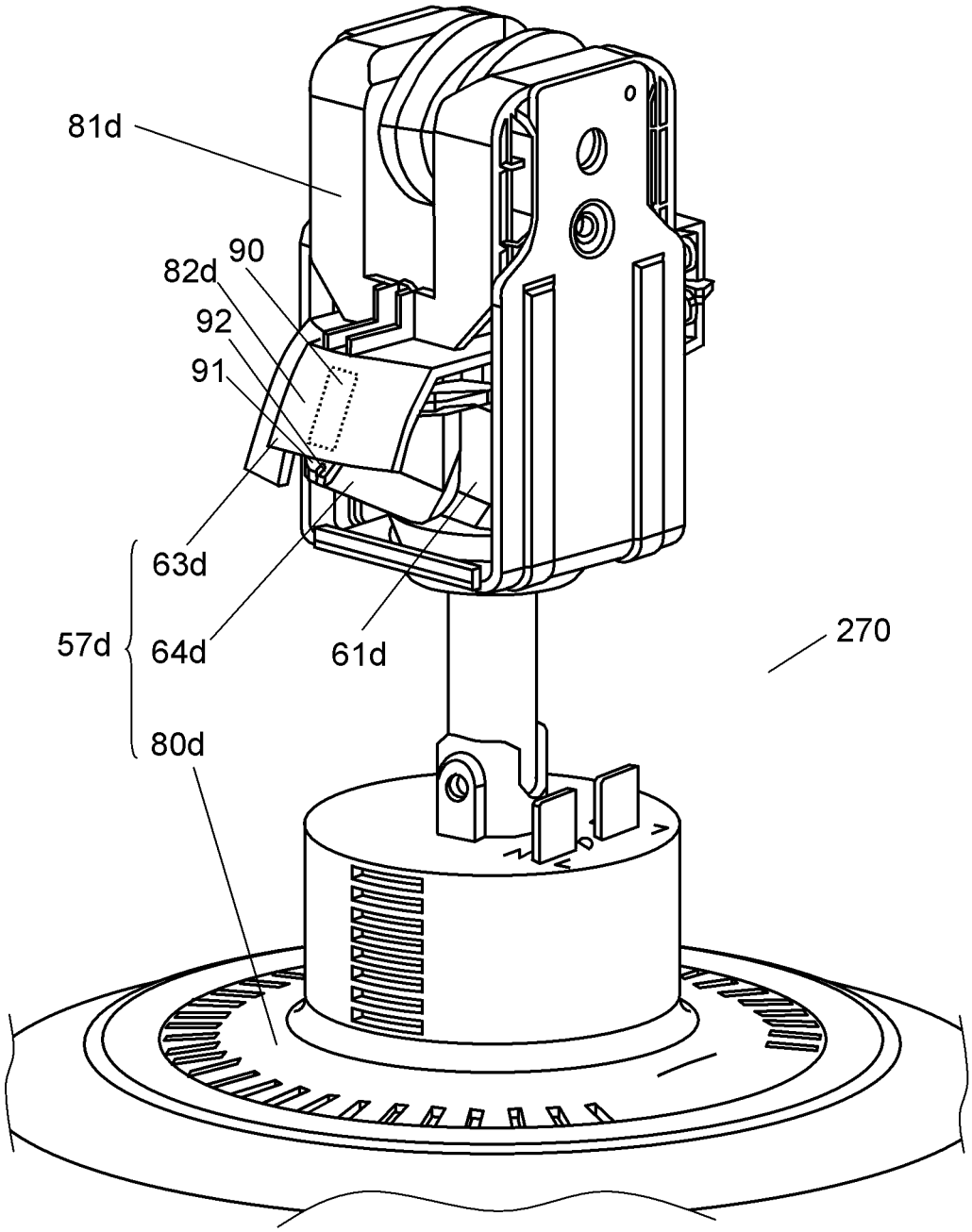
FIG. 23 is an appearance diagram showing a ceiling fan according to an eighth embodiment of the invention.
Figure 24:
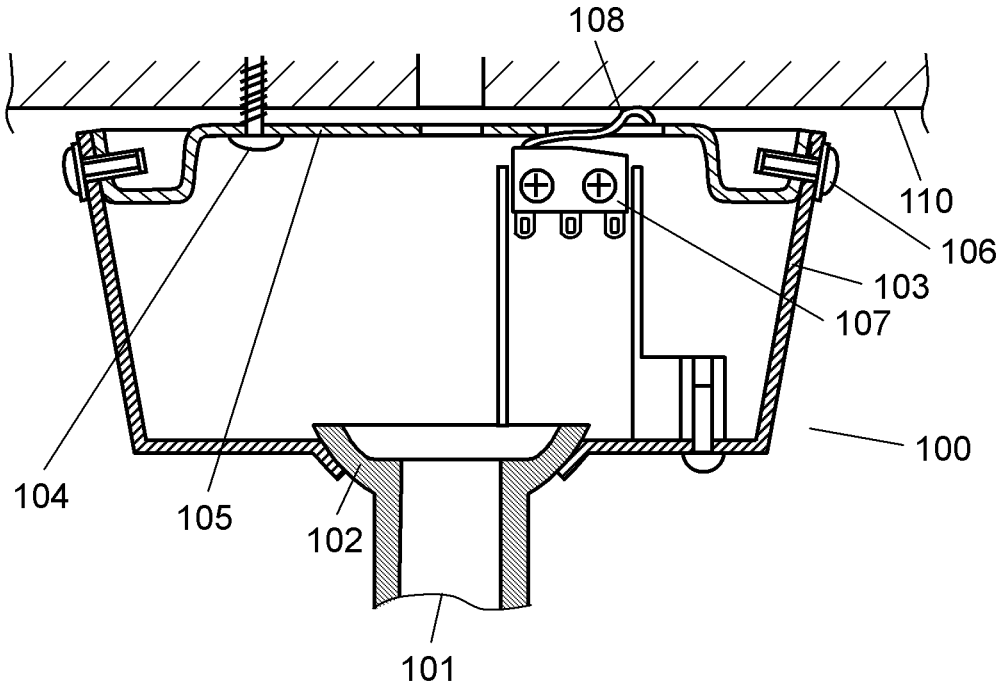
FIG. 24 PRIOR ART
FIG. 24 is a side view of an essential portion showing of a conventional ceiling fan.

In an eighth embodiment of the invention, only points which are different from the fourth embodiment are described. FIG. 23 is an appearance diagram showing a ceiling fan according to an eighth embodiment of the invention. Ceiling fan 270 of the eighth embodiment of the invention is different from ceiling fan 230 of the fourth embodiment of the invention in an abnormal-rotation detector.

Abnormal-rotation detector 57*d* includes first rotation detecting tool 63*d*, second rotation detecting tool 64*d* and control device 80*d*.

Specifically, abnormal-rotation detector 57*d* sends a displacement of a distance between first rotation detecting tool 63*d* and second rotation detecting tool 64*d* as an electric signal by second rotation detecting tool 64*d*, and when the electric signal exceeds a predetermined threshold value, control device 80*d* stops energization to the motor.

More specifically, first rotation detecting tool 63*d* includes first detecting tool mounting portion 81*d*, and shaft 49 is inserted into an upper portion of first detecting tool mounting portion 81*d*. First detecting tool mounting portion 81*d* has a U-shaped cross section and sandwiches a disk-like pulley 48. Curved first detecting tool detecting portion 82*d* is provided on a lower portion of first rotation detecting tool 63*d* so as to cover second rotation detecting tool 64*d*. Flat reflector plate 90 is fixed to an inner surface of first detecting tool detecting portion 82*d*. According to second rotation detecting tool 64*d*, infrared emitter 91 and infrared receiver 92 are fixed to a side surface of ball joint 61*d* at a position opposed to flat reflector plate 90 of first detecting tool detecting portion 82*d*. Infrared emitter 91 emits infrared rays to reflector plate 90, infrared receiver 92 receives the infrared rays reflected from reflector plate 90, and its detection value is sent to control device 80*d* as an electric signal.

Control device 80*d* is provided in ceiling fan body 44, receives the detection value from infrared receiver 92 as the electric signal. When the detection value is equal to or lower than a predetermined threshold value, control device 80*d* stops energization to the motor.

That is, in a state where fan blades are abnormally mounted, ceiling fan body 44 is operated, a large rocking motion is generated, projection 58 is cut down or broken off, and ceiling fan body 44 rotates. In such a case, infrared receiver 92 of second rotation detecting tool 64*d* detects infrared rays from reflector plate 90 of first rotation detecting tool 63*d*, and sends its detection value to control device 80*d* as an electric signal. When the detection value is equal to or lower than the predetermined threshold value, control device 80*d* can stop energization to the motor.

Thus, reflector plate 90 of first rotation detecting tool 63*d* and infrared receiver 92 of second rotation detecting tool 64*d* are in a non-contact state, and recognize that ceiling fan body 44 rotates by variation in infrared rays. Therefore, when ceiling fan body 44 rocks, it is possible to prevent infrared receiver 92 and reflector plate 90 which are abnormal-rotation detector 57*d* from being worn.

INDUSTRIAL APPLICABILITY

The ceiling fan of the present invention can be utilized as a ceiling fan for a home and for an office.

The invention claimed is:

1. A ceiling fan, comprising:

a connecting clamp configured to be fixed to a ceiling; and a ceiling fan body hanging from the connecting clamp through a hanging device, wherein the hanging device includes a first connecting portion which is mounted on the connecting clamp, and a second connecting portion provided on a lower portion of the first connecting portion, the ceiling fan body includes a motor which rotates a plurality of fan blades provided in a horizontal direction perpendicular to an axis of rotation of the motor, a shaft projecting from an upper portion of the motor, and a joint portion fixed to an upper portion of the shaft, the joint portion is movably mounted on the second connecting portion, and the ceiling fan further includes an abnormal-rotation detector which detects a rotation of the ceiling fan body and stops the motor when a body rotation-preventing device provided on the joint portion and one of the first connecting portion and the second connecting portion is released, wherein the abnormal-rotation detector includes a first rotation detecting tool and a second rotation detecting tool, the first rotation detecting tool is fixed to the second connecting portion, the second rotation detecting tool is fixed to the ceiling fan body, the first rotation detecting tool and the second rotation detecting tool are connected to each other such that when they are separated from each other by a predetermined distance when the ceiling fan body rotates, a supply of power to the motor is stopped, wherein the second rotation detecting tool is a push-on switch and the push-on switch comes into contact with the first rotation detecting tool, whereby the push-on switch is energized, and wherein the ceiling fan further includes a curved plate-like detecting portion having a predetermined width provided on a lower portion of the first rotation detecting tool, wherein the push-on switch is fixed to a side surface of the joint portion at a position opposed to the detecting portion, and the push-on switch is energized when the push-on switch is in contact with the detecting portion.

2. The ceiling fan according to claim 1, wherein the joint portion is a hemispherical ball joint having a groove in a spherical surface, the second connecting portion is formed into a bowl-like shape for movably holding the ball joint, and a notch through which the shaft can pass and the body rotation-preventing device having a projection which can be inserted into the groove are provided.

3. The ceiling fan according to claim 2, wherein the projection has a plate-like shape having the groove and a gap in a state where the projection is inserted into the groove.

4. The ceiling fan according to claim 3, wherein an angle portion at which an inner surface of the groove and an outer peripheral surface of the ball joint intersect with each other comes into contact with an end surface of the projection when the ball joint rotates in the horizontal direction.

5. The ceiling fan according to claim 2, wherein when the projection is cut down or broken off, the abnormal-rotation detector stops the motor when the ceiling fan body rotates.

6. The ceiling fan according to claim 1, further comprising a control device which sends, as an electric signal by means of the second rotation detecting tool, a displacement of a distance between the first rotation detecting tool and the second rotation detecting tool, and which stops energization to the motor when the electric signal exceeds a predetermined threshold value.

7. The ceiling fan according to claim 6, wherein the control device includes a threshold value adjustor which can adjust the threshold value.

8. The ceiling fan according to claim 6, wherein the displacement of the distance is detected by a displacement of a magnetic force by the first rotation detecting tool and the second rotation detecting tool.

9. The ceiling fan according to claim 6, wherein the displacement of the distance is detected by a displacement of infrared rays by the first rotation detecting tool and the second rotation detecting tool.

10. The ceiling fan according to claim 9, wherein the first rotation detecting tool includes a reflector plate and the second rotation detecting tool includes an infrared emitter and an infrared receiver.

11. The ceiling fan according to claim 1, wherein when the ceiling fan body rotates and the push-on switch moves beyond an edge of the detecting portion, the push-on switch becomes not in contact with the detecting portion and energization to the motor is stopped.

* * * * *